US007785761B2

(12) United States Patent
Hayashi et al.

(10) Patent No.: US 7,785,761 B2
(45) Date of Patent: Aug. 31, 2010

(54) TRANSPARENT TONER, DEVELOPER INCLUDING SAME, GLOSS-PROVIDING UNIT AND IMAGE FORMING DEVICE

(75) Inventors: Shigeru Hayashi, Kanagawa (JP); Osamu Ide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 912 days.

(21) Appl. No.: 10/940,969

(22) Filed: Sep. 15, 2004

(65) Prior Publication Data

US 2005/0214669 A1 Sep. 29, 2005

(30) Foreign Application Priority Data

Mar. 26, 2004 (JP) ..... P.2004-093469

(51) Int. Cl.
*G03G 9/087* (2006.01)

(52) U.S. Cl. ..... 430/109.4; 430/111.4

(58) Field of Classification Search ..... 430/109.4, 430/111.4

See application file for complete search history.

(56) References Cited

U.S. PATENT DOCUMENTS

| | | | | |
|---|---|---|---|---|
| 5,915,144 | A * | 6/1999 | Ide et al. | 430/45.3 |
| 6,924,075 | B2 * | 8/2005 | Tavernier et al. | 430/109.4 |
| 2003/0040585 | A1 | 2/2003 | Shirai et al. | |
| 2003/0129518 | A1 | 7/2003 | Sawada et al. | |

FOREIGN PATENT DOCUMENTS

| | | |
|---|---|---|
| JP | A-63-259575 | 10/1988 |
| JP | A-3-2765 | 1/1991 |
| JP | A-5-142963 | 6/1993 |
| JP | A-5-158364 | 6/1993 |
| JP | A-11-249339 | 9/1999 |
| JP | A-2001-222138 | 8/2001 |
| JP | 2002-284866 | 3/2002 |
| JP | 2002-318471 | 10/2002 |
| JP | A-2002-287426 | 10/2002 |
| JP | 2003-167384 | 6/2003 |
| JP | A-2003-167380 | 6/2003 |
| JP | 2004-020861 | 1/2004 |

OTHER PUBLICATIONS

Office Action of Japanese Patent Application No. 2004-093469 issued on Jul. 14, 2009 with English translation.

* cited by examiner

*Primary Examiner*—Janis L Dote
(74) *Attorney, Agent, or Firm*—Morgan, Lewis & Bockius LLP

(57) ABSTRACT

A transparent toner to be used for a transparent toner image formed with a color toner image, wherein a thermoplastic resin constituting the transparent toner is made of a resin obtained by melt-mixing a crystalline polyester resin and an amorphous resin under the conditions such that supposing that T0 (° C.) is the temperature at which the visual reflectance Y of 20 μm thick film formed by the resin obtained by melt-mixing the crystalline polyester resin and the amorphous resin for a period of time t0 (minute) is 1.5%, the melt-mixing temperature is T (° C.) and the melt-mixing time is t (minute), T (° C.) is predetermined to be from T0 to (T0+30), t (minute) is predetermined to be from t0 to (10×t0) and the temperature Tα at which the viscosity of the thermoplastic resin is $10^3$ Pa·s is from 70° C. to 110° C.

15 Claims, 10 Drawing Sheets

FIG. 8

| | Formulation | Molar ratio | Mw | Mn | Tm |
|---|---|---|---|---|---|
| A | TPA/ND/BPS | 100/95/5 | 23,000 | 12,000 | 92 |
| B | TPA/ND/BPA | 100/95/5 | 22,000 | 10,900 | 94 |
| C | TPA/ND/BPA | 100/90/10 | 22,000 | 11,000 | 90 |
| D | TPA/ND | 100/100 | 24,000 | 13,000 | 95 |
| E | TPA/ND/BPA | 100/95/5 | 43,000 | 22,000 | 96 |

FIG. 9

| | Formulation | Molar ratio | Mw | Mn | Tg |
|---|---|---|---|---|---|
| F | TPA/ND/BPA/BPS | 100/25/70/5 | 14,200 | 6,320 | 55 |
| G | TPA/ND/BPS | 100/25/75 | 13,000 | 6,000 | 90 |
| H | TPA/ND/BPA | 100/25/75 | 13,000 | 6,000 | 58 |
| I | TPA/BPS | 100/100 | 12,000 | 5,600 | 98 |
| J | TPA/BPA | 100/100 | 13,000 | 6,000 | 82 |
| K | TPA/BPA/CHDM | 100/80/20 | 13,000 | 6,000 | 65 |

FIG. 10

| | Formulation | Melt-mixing conditions | visual reflectance Y |
|---|---|---|---|
| Example 1 | A x F | 190℃,10 min. | 0.4 |
| Example 2 | A x G | 190℃,10 min. | 0.8 |
| Example 3 | A x H | 190℃,10 min. | 0.4 |
| Example 4 | B x H | 190℃,10 min. | 0.8 |
| Example 5 | B x H (4:6) | 190℃,10 min. | 1.2 |
| Example 6 | B x H (6:4) | 190℃,10 min. | 0.7 |
| Example 7 | C x H | 190℃,10 min. | 0.2 |
| Example 8 | D x H | 210℃,10 min. | 1.1 |
| Example 9 | B x I | 200℃,10 min. | 1.2 |
| Example 10 | D x K | 200℃,10 min. | 1.3 |
| Example 11 | D x J | 210℃,10 min. | 1.4 |
| Example 12 | E x J | 210℃,10 min. | 0.9 |
| Example 13 | B x H | 200℃,10 min. | 0.5 |
| Example 14 | A x F ($T\alpha'$=100℃) | 190℃,10 min. | 0.4 |
| Comparative Example 1 | E x J | 185℃,10 min. | 2.5 |
| Comparative Example 2 | A | 185℃,10 min. | 1.0 |
| Comparative Example 3 | D | 185℃,10 min. | 3.5 |
| Comparative Example 4 | E | 185℃,10 min. | 3.0 |
| Comparative Example 5 | J | 185℃,10 min. | 0.3 |
| Comparative Example 6 | K | 185℃,10 min. | 0.2 |
| Comparative Example 7 | No CT | 185℃,10 min. | 0.8 |
| Comparative Example 8 | D x H | 185℃,10 min. | 2.5 |

FIG. 11

| | <Evaluation of producibility> | <Evaluation of image quality> | | | | | | |
|---|---|---|---|---|---|---|---|---|
| | Dispersibility | Mechanical strength | Heat resistance | Glossiness | Smoothness | Y | Solidifying speed | General image quality |
| Example 1 | Good | Good | Good | Good | Good | 0.4 | Good | Good |
| Example 2 | Good | Good | Good | Good | Fair | 0.8 | Fair | Fair |
| Example 3 | Good | Good | Good | Good | Good | 0.4 | Good | Good |
| Example 4 | Fair | Good | Good | Good | Fair | 0.8 | Fair | Good |
| Example 5 | Fair | Fair | Good | Good | Good | 1.2 | Good | Good |
| Example 6 | Fair | Good | Good | Good | Fair | 0.7 | Fair | Good |
| Example 7 | Fair | Good | Fair | Good | Good | 0.2 | Good | Good |
| Example 8 | Fair | Good | Fair | Good | Good | 1.1 | Good | Good |
| Example 9 | Fair | Fair | Good | Good | Good | 1.2 | Good | Good |
| Example 10 | Fair | Fair | Fair | Good | Fair | 1.3 | Good | Good |
| Example 11 | Fair | Fair | Fair | Fair | Fair | 1.4 | Fair | Good |
| Example 12 | Fair | Good | Fair | Fair | Fair | 0.9 | Good | Fair |
| Example 13 | Fair | Fair | Good | Good | Good | 0.5 | Good | Good |
| Example 14 | Good | Fair | Good | Good | Good | 0.4 | Good | Fair |
| Comparative Example 1 | Fair | Poor | **Poor** | Poor | Poor | 2.5 | Poor | Poor |
| Comparative Example 2 | Fair | Good | Good | Good | Good | 1.0 | Poor | Fair |
| Comparative Example 3 | Poor | Good | Poor | Fair | Poor | 3.5 | Poor | Poor |
| Comparative Example 4 | Poor | Good | Poor | Good | Poor | 3.0 | Poor | Poor |
| Comparative Example 5 | Poor | Poor | Good | Poor | Poor | 0.3 | Good | Poor |
| Comparative Example 6 | Fair | Poor | Poor | Fair | Poor | 0.2 | Good | Poor |
| Comparative Example 7 | - | Good | Good | Good | **Poor** | 0.8 | Good | Poor |
| Comparative Example 8 | Fair | Fair | Fair | Good | Fair | 2.5 | Fair | Poor |

TRANSPARENT TONER, DEVELOPER INCLUDING SAME, GLOSS-PROVIDING UNIT AND IMAGE FORMING DEVICE

BACKGROUND OF THE INVENTION

1. Field of the Invention

The present invention relates to a transparent toner for forming a transparent toner image formed on a recording medium with a color toner image and more particularly to improvements in transparent toner useful in electrophotography adapted to be transferred and fixed onto or around a color toner image which is desired to be provided with gloss such as photographic image by electrophotography, developer including the transparent toner, gloss-providing unit and image forming device.

2. Background Art

In order to form a color image on the surface of a recording medium or make a color duplicate using a color image forming device capable of forming a color image by an electrophotographic process, electrostatic recording process or the like, it has been hereto fore practiced to execute the following image forming steps.

In some detail, a color original is irradiated with light beam. The light beam reflected by the color original is then color-separated and read by a color scanner. The data thus read is then subjected to predetermined image processing or color correction by an image processor to give a plurality of color image signals according to which a semiconductor laser or the like is then modulated to emit laser beams modulated by the image signals. The surface of an image carrier made of an inorganic photoreceptor such as selenium and amorphous silicon or an organic photoreceptor including a charge-generating layer made of a phthalocyanine dye, bisazo pigment or the like is irradiated with these laser beams by a plurality of times for each color to form a plurality of electrostatic latent images. These electrostatic latent images are then sequentially developed with four color toners of yellow (Y), magenta (M), cyan (C) and black (K). The toner images thus developed are then transferred from the image carrier made of an inorganic or organic photoreceptor onto a recording medium such as paper on which they are then fixed by, e.g., a heat-pressing process fixing unit. In this manner, a color image is formed on the surface of the recording medium.

While the color image thus formed is smoothened on the surface thereof during heat fixing and thus has some gloss, the paper which is a recording medium normally has no gloss. Thus, the color image has a glossiness different from that of the paper. It is also known that some kinds of the binder resin to be incorporated in the color toners or some heat fixing processes cause the toners to change in its viscosity during heat fixing, resulting in the change of glossiness of the color image, as disclosed in JP-A-5-142963, JP-A-3-2765, JP-A-63-259575, JP-5-158364, JP-A-2001-222138, JP-A-11-249339, JP-A-2002-287426 and JP-A-2003-167380.

The tastes in the glossiness of color image differ widely with the kind of images, purpose, etc. In the case of photographic originals such as person and scenery, high gloss images prevail in people's tastes from the standpoint of sharpness in image quality.

As techniques for obtaining a high gloss image by a color image forming device there have been already proposed techniques in Patent References 1 to 3, etc. According to these references, the use of a color copying machine with properly selected toners, fixing conditions, etc. makes it possible to obtain a high gloss image.

In accordance with these proposed techniques, the glossiness of the image area formed by the toners can be raised, but the glossiness of the non-image area cannot be raised, making it impossible to uniformalize the glossiness of the surface of the recording medium. These techniques are also disadvantageous in that an uneven surface of color toners remains on the surface of the image, making it impossible to attain smoothness as in silver salt system photograph or print and hence give a smooth texture.

Further, JP-5-158364 discloses a device capable of heat-melting a recording medium having a color toner image and a transparent toner image formed thereon by a belt type fixing unit and then cooling and peeling the fixing unit from the recording medium to form an image having a high gloss as attained in silver salt system photograph.

However, the aforementioned device is disadvantageous in that there occurs a prominent step on the border of high density are a with low density area. In particular, there occurs a depression like a hole at a small spot of low density in high density area. This phenomenon is attributed to the fact that the binder resin in the transparent toner is not fluid enough to fill the step in the color toner image. This phenomenon becomes remarkable when the recording medium passes through the fixing unit at a high speed. Thus, the above cited techniques are disadvantageous in that both the requirements for high printing speed and high gloss and uniformity in image cannot be attained at the same time so far as the fixing unit is used under practical temperature and pressure conditions.

Moreover, the transparent toner to be used in the above cited techniques is disadvantageous in that the transparent toner layer thus fixed undergoes durability troubles such as deformation and offset under high temperature and humidity conditions or after prolonged storage.

In other words, taking into account the reduction of energy consumption by image making, low temperature fixability is essential. In order to satisfy the desired low temperature fixability, it is an effective solution to reduce the molecular weight of the resin and lower the glass transition point of the resin.

On the other hand, there is an apprehension that an image having a smooth surface like a photograph is subject to blocking (bonded so firmly that the two sheets cannot be peeled off each other or, if peeled, the surface of image is damaged) when stored in automobile or warehouse in summer time or allowed to stand at high temperature as in transportation at the ship bottom while being superposed on the surface or back surface of another image or on material of album.

In this case, in order to improve durability at high temperature, i.e., heat resistance, it is effective to raise the glass transition point and the molecular weight of the resin.

Further, the enhancement of toughness against bending of image, i.e., mechanical strength of image, too, is an important assignment. In order to enhance mechanical strength, it is an effective solution to raise the molecular weight of the resin.

Thus, the enhancement of mechanical strength and heat resistance is contrary to the enhancement of low temperature fixability. In particular, in order to make an image having a high gloss as in silver salt system photograph, it is necessary to further raise the fixing temperature. Therefore, it is more difficult to satisfy all the three requirements at the same time.

With the recent demand for binder resin having an excellent low temperature fixability and a good preservability, the use of a crystalline polyester resin as disclosed in JP-A-2003-167380 or the combined use of a crystalline polyester resin and an amorphous polyester resin as disclosed in Patent References 5 to 7 has been studied. These approaches are considered to be an effective technique for accomplishing both low temperature fixability and heat resistance and durability against offset and blocking. When these techniques are applied to transparent toner, both the low temperature fixability and durability can be observed enhanced. However, the resulting fixed image becomes cloudy due to crystal dispersion structure (spherulite dispersion structure) characteristic to crystalline polyester resin and thus loses sharpness. These techniques are also disadvantageous in that the resulting image undergoes embrittlement and gloss change due to slow progress of crystallization over an extended period of time.

The related art transparent toner including an amorphous resin is also disadvantageous in that it has a low mechanical strength against bending and thus easily undergoes cracking. The transparent toner including a crystalline resin stays flexible after fixed but can undergo cracking more easily than the transparent toner including an amorphous resin due to the effect of crystal interface when time elapses until crystallization proceeds.

An image including a photographic color toner image and a transparent toner image has a high bulk of toner and thus undergoes a high stress when given a bending mechanical force. Thus, such an image undergoes cracking even when given a small external force. Cracks on a uniform glossy surface are very prominent and thus drastically the value of print.

SUMMARY OF THE INVENTION

The invention has been worked out to solve the aforementioned technical problems. An aim of the invention is to provide a transparent toner which can provide an image with a high gloss that is uniform over the entire surface thereof as in silver salt photograph and an excellent heat resistance and mechanical strength and can easily satisfy desired low temperature fixability attained by a fixing unit having a small energy consumption, a developer including the transparent toner, a gloss-providing unit and an image forming device.

The inventors found that the formation of a transparent toner image having specific properties on a color toner image formed on a recording medium makes it possible to obtain an image having a high quality identical to that of silver salt system photograph at a reduced energy consumption without leaving any step between the surface of the recording medium and the color toner image even if a high speed fixing unit is used and inhibit image quality deterioration such as offset and crack caused by the effect of heat and moisture during prolonged storage. The invention has thus been worked out.

In other words, the invention has been worked out on the basis of the following knowledge. In some detail, as shown in FIG. 1A, there is provided a transparent toner to be used for a transparent toner image formed with a color toner image on a recording medium, wherein a thermoplastic resin constituting the transparent toner is made of a resin obtained by melt-mixing a crystalline polyester resin and an amorphous resin and the melt-mixing conditions are predetermined such that the temperature, time and viscosity are optimized.

In some detail, the melt-mixing conditions are characterized in that supposing that T0 (° C.) is the temperature at which the visual reflectance Y of 20 μm thick film formed by the resin obtained by melt-mixing the crystalline polyester resin and the amorphous resin for a period of time t0 (minute) is 1.5%, the melt-mixing temperature is T (° C.) and the melt-mixing time is t (minute), T (° C.) is predetermined to be from T0 to (T0+30), t (minute) is predetermined to be from t0 to (10×t0) and the temperature Tα at which the viscosity of the thermoplastic resin is $10^3$ Pa·s is from 70° C. to 110° C.

In the aforementioned technical method, the transparent toner of the invention can find wide application but is particularly for electrophotography. In this case, the transparent toner is adapted to be transferred and fixed on or around a color toner image formed on a recording medium with a color toner including at least a thermoplastic resin and a coloring agent by, e.g., electrophotographic process (or electrostatic recording process).

Further, as the thermoplastic resin constituting the transparent toner there may be used one obtained by mixing a crystalline polyester resin and an amorphous resin. Representative examples of the amorphous polyester resin employable herein include amorphous polyester resin, but the invention is not limited thereto. Styrene acryl-based resins, etc. may be used as well.

Referring to the melt-mixing conditions, when the temperature T (° C.) is less than T0 and the time t (minute) is less than t0, the two resins cannot be thoroughly mixed, causing the deterioration of mechanical strength and heat resistance. On the contrary, when the temperature T (° C.) is more than (T0+30) or the time t (minute) is more than (10×t0), the resulting thermoplastic resin becomes plasticized and thus exhibits deteriorated heat resistance.

From the standpoint of heat resistance and mechanical strength, the temperature T (° C.) and the time t (minute) are preferably predetermined to be from (T0+5) to (T0+10) and from to t0 (3×t0), respectively.

When the resulting thermoplastic resin satisfies the above viscosity requirements, the transparent toner image can cover the color toner image substantially entirely, whereby a smooth and highly glossy image surface can be obtained When the temperature Tα at which the viscosity of the resulting thermoplastic resin is $10^3$ Pa·s is less than 70° C., the resulting thermoplastic resin exhibits so poor a heat resistance that it undergoes blocking or other troubles when allowed to stand at high temperatures. On the contrary, when the temperature Tα is more than 110° C., a smooth high gloss image surface cannot be obtained at the fixing step. Even a fixed image surface has a step left on the border of high density area with low density area.

Referring to the thermoplastic resin constituting the transparent toner, the mixing ratio of the crystalline polyester resin and the amorphous resin (e.g., amorphous polyester resin) by weight is preferably from 35:65 to 65:35 taking into account heat resistance, mechanical strength and melt-mixability.

In a preferred embodiment of the transparent toner, the crystalline polyester resin and the amorphous resin include an alcohol-derived constituent or an acid-derived constituent in common with each other. In particular, the crystalline polyester resin and the amorphous resin each are formed by three or more monomers and at least one alcohol-derived constituent and one acid-derived constituent which are in common with each other. More preferably, the kind of the alcohol-derived constituents and the acid-derived constituents each are all common to the two resins.

When the two resins have a structure derived from a constituent in common with each other, they have a raised miscibility and thus can be more easily melt-mixed. As a result, the energy required to mix the two resins can be reduced to inhibit plasticization due to mixing, making it possible to raise heat resistance due to decrease in plasticization by mixing as well as crystal dispersibility and hence transparency.

In a preferred embodiment of the alcohol-derived constituents and acid-derived constituents of the crystalline polyester resin, the alcohol-derived constituents include a $C_6$-$C_{12}$ straight-chain aliphatic group as a main component in an amount of from 85 to 98 mol-% based on the total amount of the alcohol-derived constituents and the acid-derived constituents of the crystalline polyester resin include the aromatic group derived from terephthalic acid, isophthalic acid or naphthalenedicarboxylic acid as a main component in an amount of 90 mol-% or more based on the total amount of the acid-derived constituents.

On the other hand, in a preferred embodiment of the alcohol-derived constituents and acid-derived constituents of the amorphous polyester resin, the same straight-chain aliphatic group as the $C_6$-$C_{12}$ straight-chain aliphatic group which is a main component of the alcohol-derived constituents of the crystalline polyester resin is contained in an amount of from 10 to 30 mol-% based on the total amount of the alcohol-derived constituents. The acid-derived constituents of the amorphous polyester resin include the same aromatic group as the aromatic group derived from terephthalic acid, isophthalic acid or naphthalenedicarboxylic acid which is a main component of the acid-derived constituents of the crystalline polyester resin in an amount of 90 mol-% or more based on the total amount of the acid-derived constituents.

In an embodiment which is more desirable for the satisfaction of low temperature fixability, heat resistance and heat-mixability, the alcohol-derived constituents of the crystalline polyester resin include a $C_6$-$C_{12}$ straight-chain aliphatic group and an aromatic diol-derived component in an amount of from 85 to 98 mol-% and from 2 to 15 mol-% based on the total alcohol-derived constituents, respectively. The alcohol-derived constituents of the amorphous polyester resin among the amorphous resins include the same straight-chain aliphatic component and aromatic diol-derived component as the main component of the alcohol-derived constituents of the crystalline polyester resin in an amount of from 10 to 30 mol-% and from 70 to 90 mol-% based on the total amount of the alcohol-derived constituents, respectively. The aromatic component which is a main component of the acid-derived constituents of the crystalline polyester resin and the amorphous polyester resin are formed by the same material.

In a preferred embodiment of the weight-average molecular weight of the crystalline polyester resin and amorphous polyester resin, the weight-average molecular weight of the crystalline polyester resin and the amorphous polyester resin are from 17,000 to 40,000 and from 8,000 to 16,000, respectively, from the standpoint of low temperature fixability and mechanical strength.

Further, referring to the formulation of the crystalline polyester resin, the crystalline polyester resin preferably includes bisphenol S or bisphenol S-alkylene oxide adduct incorporated therein in an amount of from 2 to 15 mol-% based on the total amount of the diol-derived constituents. Similarly, the amorphous polyester resin preferably includes bisphenol S or bisphenol S-alkylene oxide adduct incorporated therein in an amount of from 2 to 90 mol-% based on the total amount of the diol-derived constituents.

Since the transparent toner of the invention has a flexible resin structure to have an enhanced mechanical strength, it is difficult to produce the toner by grinding method. Accordingly, for the production of the toner, a proper method may be selected from known wet methods. In this case, a resin having a structure derived from bisphenol S has a high affinity for water and thus is favorable for wet process production in an aqueous system. Further, since the aforementioned hydrophilic group is nonionic, wet process production in a non-aqueous system may be selected. The resulting toner exhibits a high environmental stability and can satisfy both the requirements for chargeability and producibility. The resin has a high effect of dispersing crystal and thus is favorable for enhancement of transparency. The heat resistance of the toner cannot be impaired by copolymerization so far as the mixing ratio is as defined above. However, since bisphenol S has a high effect of destroying crystallinity, the temperature Tm at which the viscosity of the thermoplastic resin of the transparent toner is $10^3$ Pa·s shows a remarkable change. Bisphenol S has an effect of enhancing the heat resistance of the amorphous polyester resin. From the standpoint of low. temperature fixability, bisphenol A is preferably used in combination with other third components such as bisphenol A derivative depending on the glass transition point (Tg) of the amorphous resin.

Supposing that Tα (° C.) is the temperature at which the viscosity of the thermoplastic resin constituting the transparent toner is $10^3$Pa·s and Tα' (° C.) is the temperature at which the viscosity of the thermoplastic resin contained in a color toner is $10^4$Pa·s, Tα and Tα' satisfy the following relationship (1) to effectively prevent the occurrence of bubbles or image disturbance (lack of graininess, collapsed image, etc.):

$$T\alpha \leqq T\alpha' \leqq T\alpha + 25 (^\circ \text{C.}) \quad (1)$$

The invention is not limited to the aforementioned transparent toner but also concerns a developer including a transparent toner and capable of developing as a transparent toner image. Examples of the developer employable herein include a wide range of developers such as one-component developer including a transparent toner as a main component and a two-component developer including a carrier besides transparent toner.

The invention further concerns a gloss-providing unit using a developer containing a transparent toner.

In this case, the invention concerns a gloss-providing unit to be used in an image forming device for forming a color toner image on a recording medium which provides the color toner image on the recording medium with gloss, wherein a transparent toner image can be formed on or around the color toner image on the recording medium using a developer including the transparent toner mentioned above.

The invention further concerns an image forming device.

In this case, the invention is characterized by an image forming device for forming a color toner image 4 and a transparent toner image 5 on a recording medium 1, including at least the aforementioned gloss-providing unit 6 and an imaging unit 2 for forming the color toner image 4 and the transparent toner image 5 on the recording medium 1 and a fixing unit 3 for fixing the toner images 4, 5 formed by the imaging unit 2 on the recording medium 1 as shown in FIG. 1B.

As the recording medium 1 there is preferably used, e.g., one including a base substrate 1*a* made of raw paper and a light-scattering layer 1*b* provided on the base substrate 1*a*. As the light-scattering layer 1*b* there may be used one including a white pigment incorporated in a thermoplastic resin.

In a preferred embodiment of the fixing unit 3 of the aforementioned image forming device, there are preferably provided a fixing member 3*a* for clamping an image G on the recording medium 1 to fix it, a heat-pressing unit 3*b* for heat-pressing the color toner image 4 and the transparent toner image 5 on the recording medium 1 and a cooling/peeling unit 3*c* for cooling the toner images 4, 5 thus heat-pressed to peel the toner images off the fixing member 3*a*.

Thus, when the toner images thus heat-pressed are cooled and peeled off the fixing member 3*a*, the surface conditions of the fixing member 3*a* are transferred to the surface of the recording medium 1 as they are. Accordingly, when the surface conditions of the fixing member 3*a* are good, a desirable image structure can be obtained.

This type of an image forming device may include the gloss-providing unit 6 in addition to the various existing elements for forming color toner images. In a representative embodiment, the imaging unit 2 may include an image carrier (not shown) for supporting the color toner image 4 and the transparent toner image 5, a transferring unit (not shown) for transferring the color toner image 4 and the transparent toner image 5 onto the recording medium 1 and the gloss-providing unit 6 for forming the transparent toner image 5 on the image carrier.

In another embodiment, the gloss-providing unit 6 may form the transparent toner image 5 on the position located upstream from the heat-pressing unit 3*b* in the fixing member 3*a* of the fixing unit 3 and the transparent toner image 5 can be superposed on the color toner image 4 on the recording medium 1 by the heat-pressing unit 3*b*.

In accordance with the invention, as the thermoplastic resin constituting the transparent toner there is used a mixture of a crystalline polyester resin and an amorphous resin. Further, the conditions under which the two resins are melt-mixed (temperature, time, viscosity) are optimized. As a result, it is made assured that a transparent toner which can satisfy all the requirements for mechanical strength, heat resistance and low temperature fixability, can be solidified at a high speed and is needed to obtain a desirable image having a high general quality can be provided.

Further, when a developer including the aforementioned transparent toner is used, a transparent toner image can be developed on the recording medium together with a color toner image, making it easy to obtain a desirable image.

Moreover, a gloss-providing unit for forming a desirable image using such a transparent toner or an image forming device including this gloss-providing unit can be easily constructed.

BRIEF DESCRIPTION OF THE DRAWINGS

These and other objects and advantages of this invention will become more fully apparent from the following detailed description taken with the accompanying drawings in which:

FIG. 8 is a diagram illustrating the crystalline polyester resins A to E used in Examples 1 to 14 and Comparative Examples 1 to 8;

FIG. 9 is a diagram illustrating the amorphous polyester resins F to K used in Examples 1 to 14 and Comparative Examples 1 to 8;

FIG. 10 is a diagram illustrating the formulation, the melt-mixing conditions and the visual reflectance of the transparent toners of Examples 1 to 14 and Comparative Examples 1 to 8; and FIG. 11 is a diagram illustrating the evaluation of producibility and image quality of Examples 1 to 14 and Comparative Examples 1 to 8.

DETAILED DESCRIPTION OF THE PREFERRED EMBODIMENTS

The invention will be further described hereinafter with reference to embodiments shown in the attached drawings.

Embodiment 1

Figure 1A:
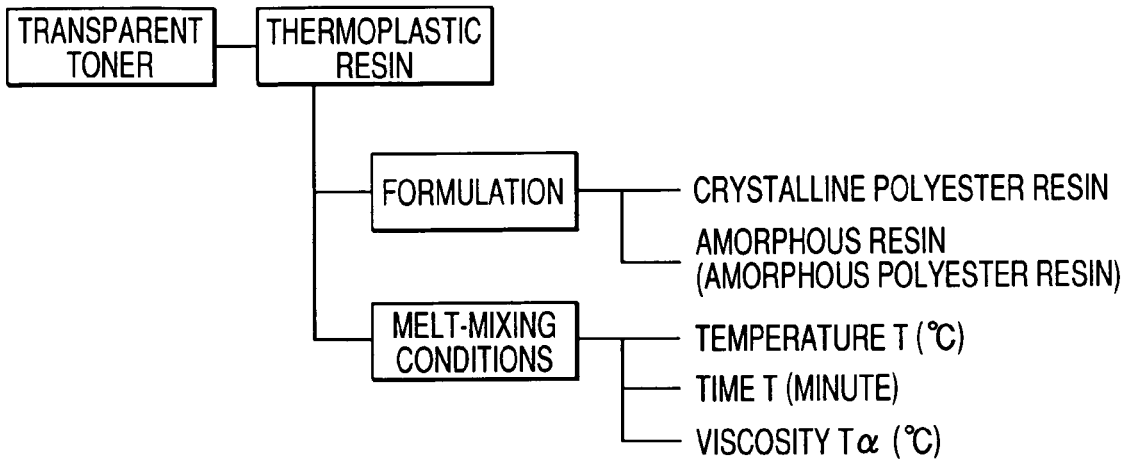
FIG. 1A is a diagram illustrating the outline of a transparent toner according to the invention.
Figure 1B:
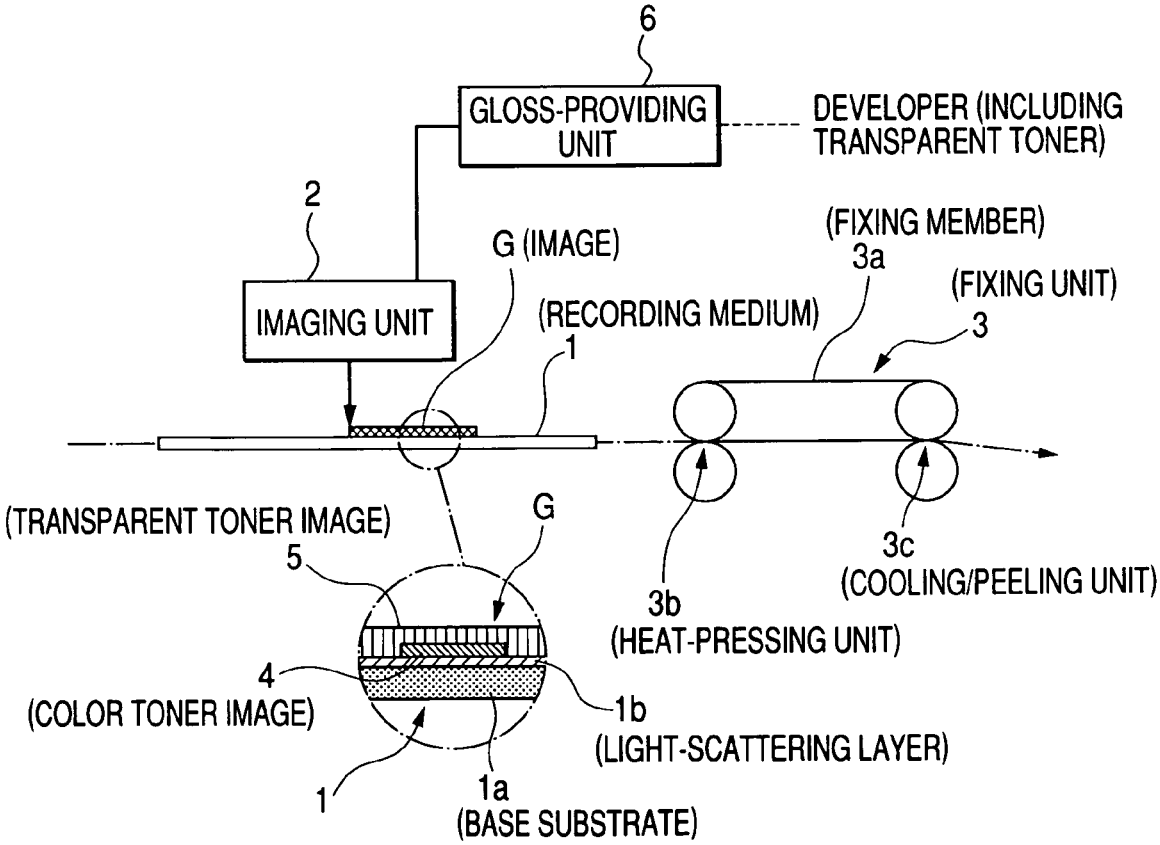
FIG. 1B is a diagram illustrating the outline of a gloss-providing unit according to the invention and an image forming device including the gloss-providing unit.
Figure 2:
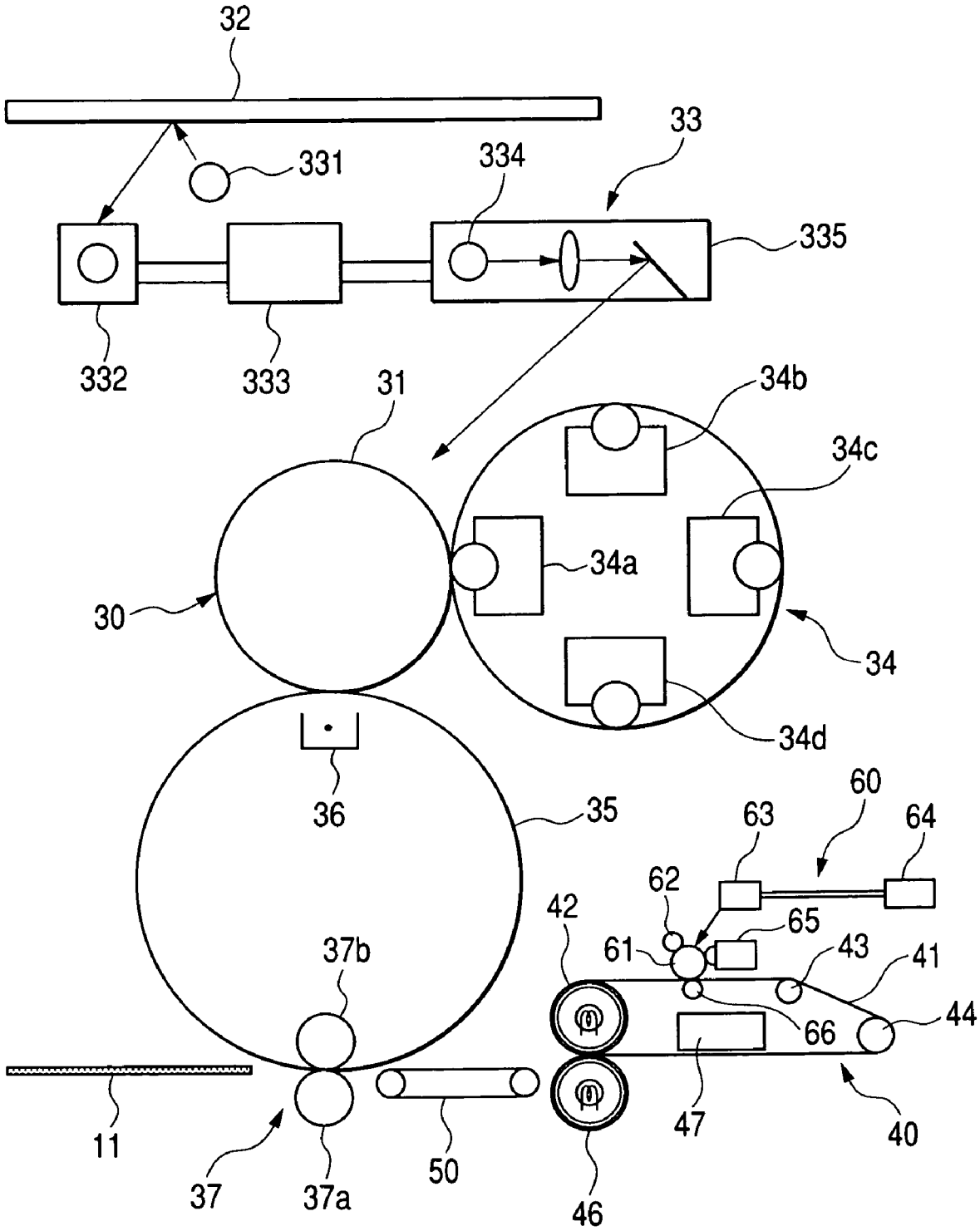
FIG. 2 is a diagram illustrating the general configuration of the image forming device used in the embodiment 1.

FIG. 2 illustrates the embodiment 1 of the color image forming device to which the invention is applied.

In FIG. 2, the color image forming device according to the present embodiment includes an imaging unit 30 for forming a color image on a recording medium 11, a fixing unit 40 for fixing various toner images formed on the recording medium 11 by the imaging unit 30 and a conveying unit 50 for conveying the recording medium 11 to the fixing unit 40.

Figure 3A:
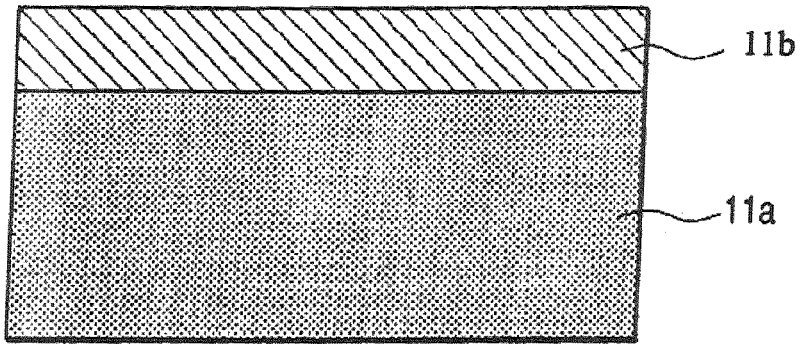
FIG. 3A is a diagram illustrating the configuration of the recording medium used in an embodiment of implementation of the invention.

In the present embodiment, the recording medium is not specifically limited. A resin sheet such as OHP sheet may be used, not to mention ordinary copying paper and regular paper. All sheet-like media on which an image can be formed with a transparent toner according to the present embodiment can be used. A preferred embodiment of the recording medium 11 is a base substrate 11*a* made of raw paper having a basis weight of from 100 to 200 g/m$^2$ including at least a light-scattering layer 11*b* having a thickness of from 10 to 50 μm containing a white pigment and a thermoplastic resin provided thereon as shown in FIGS. 2 and 3A.

The reason why the base substrate 11*a* having a basis weight of from 100 to 200 g/m$^2$ is desirable is based on the supposition of the thickness range of the base substrate 11*a* desirable as photographic paper. The definition of the thickness range of the light-scattering layer 11*b* is made taking into account the fact that when the thickness of the light-scattering layer 11*b* is less than 10 μm, the surface of the light-scattering layer 11*b* can be uneven while when the thickness of the light-scattering layer 11*b* is more than 50 μm, the material is too bulky.

Further, as the white pigment to be incorporated in the light-scattering layer 11*b* there may be used any known white particulate pigment such as titanium oxide and calcium carbonate. The light-scattering layer 11*b* preferably includes titanium oxide as a main component to enhance the whiteness. The weight proportion of the white pigment is preferably from 20 to 40 parts by weight based on 100 parts by weight of the thermoplastic resin.

In this arrangement, an image having a smooth surface, a high glossiness, a sharp color tone and a smooth graininess which causes no offset as viewed on the back side can be provided.

The transparent toner to be used in the present embodiment will be further described hereinafter.

The transparent toner of the invention is an electrophotographic transparent toner which is adapted to be transferred and fixed on or around a color toner image formed on the surface of a recording medium 11 with a color toner including at least a thermoplastic resin and a color toner including a coloring agent by an electrophotographic process.

Figure 3B:
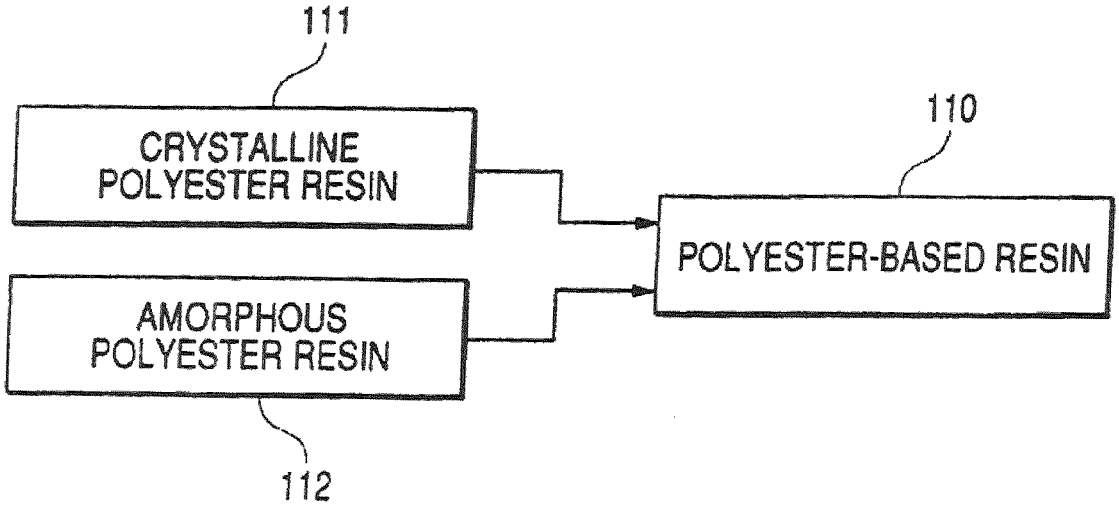
FIG. 3B is a diagram illustrating the transparent toner used in an embodiment of the invention.

In particular, in accordance with the transparent toner to be used in the present embodiment, the thermoplastic resin which is the main component of the transparent toner is a polyester-based resin 110 obtained by melt-mixing a crystalline polyester resin 111 and an amorphous polyester resin 112 and the temperature Tα at which the viscosity of the thermoplastic resin is $10^3$ Pa·s is from 70° C. to 110° C. as shown in FIG. 3B.

The components contained in the transparent toner according to the present embodiment can be roughly divided into two groups, i.e., thermoplastic resin and other components. The following description will be made mainly on the thermoplastic resin and the other components. Further, the physical properties and production method of the toner and other factors defining the transparent toner according to the present embodiment will be described hereinafter.

<Thermoplastic Resin>

The thermoplastic resin to be used in the transparent toner according to the present embodiment includes a polyester resin in an amount of 70% by weight or more based on the total weight of the binder resin. The proportion of the polyester resin in the total weight of the binder resin components is preferably 80% by weight or more, more preferably 90% by weight or more, particularly 100% by weight. In the present embodiment, a polymer obtained by copolymerizing the main chain of the aforementioned polyester resin with other components, too, may be referred to as "polyester resin" if the content of the other components (third components) is 50 mol-% or less. Thus, the main chain of the polyester resin may be copolymerized with proper third components as necessary for the purpose of adjusting melting point. The copolymerizing proportion of the other components is preferably 12.5 mol-% or less, more preferably 2 mol-% or less.

The number of the crystalline polyester resins and the amorphous polyester resins constituting the thermoplastic resin each may be one. However, two or more crystalline polyester resins and amorphous polyester resins may be each used in admixture.

Crystalline Polyester Resin

The melting point of the aforementioned crystalline polyester resin is from 80° C. to 130° C., preferably from 80° C. to 100° C., more preferably from 85° C. to 95° C. The weight-average molecular weight of the crystalline polyester resin is from 15,000 to 50,000, preferably from 17,000 to 40,000 from the standpoint of low temperature fixability and mechanical strength. In the present embodiment, the melting point of the aforementioned crystalline polyester resin was measured using a differential scanning calorimeter (DSC). In some detail, the temperature at which the top endothermic peak occurs during the measurement at a temperature rising rate of 10° C. per minute from room temperature to 150° C. was determined.

In the present embodiment, the term "crystalline" as in "crystalline polyester resin" is meant to indicate that the polyester resin shows a definite endothermic peak rather than stepwise endothermic change as measured by a differential scanning calorimeter (DSC). A polymer obtained by the copolymerization of the main chain of the aforementioned crystalline polyester resin with other components, too, may be referred to as "crystalline polyester resin" if the amount of the other components is small and a definite endothermic peak is shown as determined by a differential scanning calorimeter (DSC).

In order to enhance the flexibility of the resin, the alcohol-derived constituents of the aforementioned crystalline polyester resin are preferably $C_6$-$C_{12}$ straight-chain aliphatic groups.

The alcohol which forms the aforementioned alcohol-derived constituent is preferably an aliphatic diol.

Specific examples of the aliphatic diol employable herein include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecane diol, and 1,20-eicosanediol. However, the invention is not limited to these compounds. Preferred among these aliphatic diols are $C_6$-$C_{12}$ straight-chain aliphatic diols, more preferably nonanediol having 9 carbon atoms from the standpoint of fixability and heat resistance.

From the standpoint of melt-mixability and low temperature fixability, there are preferably contained the aforementioned $C_6$-$C_{12}$ straight-chain aliphatic diols in an amount of from 85 to 98 mol-% based on the total amount of the alcohol-derived constituents.

Examples of the acid which forms the aforementioned acid-derived constituent include various dicarboxylic acids such as aromatic dicarboxylic acid and aliphatic dicarboxylic acid. Preferred among these dicarboxylic acids are aromatic dicarboxylic acids from the standpoint of melt-mixability, mechanical strength and heat resistance.

Examples of the aromatic dicarboxylic acids employable herein include terephthalic acid, dimethyl terephthalate, isophthalic acid, dimethyl isophthalate, 2,6-naphthalenedicarboxylic acid, and 4,4'-biphenyl dicarboxylic acid. Preferred among these aromatic dicarboxylic acids are terephthalic acid, dimethyl terephthalate, isophthalic acid, dimethyl isophthalate and 2,6-naphthalenedicarboxylic acid from the standpoint of low temperature fixability and mechanical strength. In order to keep desired melt-mixability, the amount of the aromatic components is preferably 90 mol-% or more based on the total amount of the acid-derived constituents.

Examples of the aliphatic dicarboxylic acids employable herein include oxalic acid, malonic acid, succinic acid, glutaric acid, adipic acid, pimelic acid, sberic acid, azelaic acid, sebacic acid, 1,9-nonanedicarboxylic acid, 1,10-decanedicarboxylic acid, 1,11-undecanedicarboxylic acid, 1,12-dodecane dicarboxylic acid, 1,13-tridecanedicarboxylic acid, 1,14-tetradecanedicarboxylic acid, 1,16-hexadecane dicarboxylic acid, 1,18-octadecanedicarboxylic acid, and lower alkyl ester or acid anhydride thereof. However, the invention is not limited to these compounds.

In order to enhance melt-mixability, third components are preferably subjected to copolymerization in an amount of from 2 to 12.5 mol-%. When the proportion of the third components decreases, melt-mixability is deteriorated, making it necessary that the mixing temperature be raised or the mixing time be prolonged, deteriorating producibility as well as heat resistance. On the contrary, when the proportion of the third components exceeds the above defined range, melt-mixability can be raised, but crystallinity is decreased, deteriorating heat resistance. When heat resistance is deteriorated, problems such as blocking and offset occur when the printed matters are stored between pages of album or the paper itself is stored in a high temperature warehouse or automobile.

As the third components there are preferably used diol components such as bisphenol A, bisphenol A-ethylene oxide adduct, bisphenol A-propylene oxide adduct, hydrogenated bisphenol A, bisphenol S, bisphenol S-ethylene oxide adduct and bisphenol S-propylene oxide adduct from the standpoint of enhancement of melt-mixability. Bisphenol S derivatives such as bisphenol S, bisphenol S-ethylene oxide adduct and bisphenol S-propylene oxide adduct are particularly preferred from the standpoint of toner producibility, heat resistance and transparency.

Further, there are preferably contained alcohol-derived third components in an amount of from 2 to 15 mol-%, more preferably from 3 to 8 mol-% based on the total amount of the alcohol-derived constituents from the standpoint of heat resistance.

As the third component there may be added an acid-derived constituent from the standpoint of melt-mixability. The incorporation of two or more acid-derived constituents makes it possible to lower crystallinity and hence enhance melt-mixability. In order to avoid the deterioration of heat resistance by the deterioration of crystallinity, the proportion of this third component based on the total amount of the acid-derived constituents is preferably 10% or less.

The method for the production of the aforementioned crystalline polyester resin is not specifically limited. The crystalline polyester resin can be produced by an ordinary polyester polymerization method involving the reaction of acid component with alcohol component. In some detail, a dibasic acid and a divalent alcohol may be subjected to esterification reaction or ester exchange reaction to obtain an oligomer which is then subjected to polycondensation reaction in vacuo. Alternatively, as disclosed in JP-B-53-37920, the crystalline polyester resin can be obtained by the depolymerization of a polyester. At least a dicarboxylic acid alkyl ester such as dimethyl terephthalate may be used as a dibasic acid. The dicarboxylic acid alkyl ester may be subjected to ester exchange reaction followed by polycondensation reaction or may be subjected to direct esterification with a dicarboxylic acid followed by polycondensation reaction.

For example, a bibasic acid and a divalent alcohol may be reacted at a temperature of from 180° C. to 200° C. in the atmosphere for 2 to 5 hours. Thereafter, the distillation of water or alcohol is terminated to complete the ester exchange reaction. Subsequently, the product is heated to a temperature of from 200° C. to 230° C. while the pressure in the reaction system is raised to a value as high as 1 mmHg or less. The product is then heated to the same temperature for 1 to 3 hours to obtain a crystalline polyester resin.

Amorphous Polyester Resin

The aforementioned amorphous polyester resin has a glass transition point (Tg) of from 50° C. to 80° C., preferably from 55° C. to 65° C. The weight-average molecular weight of the amorphous polyester resin is from 8,000 to 30,000, preferably from 8,000 to 16,000 from the standpoint of low temperature fixability and mechanical strength. The amorphous polyester resin may be copolymerized with a third component from the standpoint of low temperature fixability and mixability.

It is preferred that alcohol-derived constituents or acid-derived constituents which are in common with the aforementioned crystalline polyester resin be incorporated to enhance melt-mixability. In particular, in the case where the main component of the alcohol-derived constituents of the crystalline polyester resin is a straight-chain aliphatic group component and the main component of the acid-derived constituents of the crystalline polyester resin is an aromatic component, the incorporation of the same straight-chain aliphatic alcohol-derived constituents as mentioned above and the same acid-derived constituents as mentioned above in an amount of from 10 to 30 mol-% based on the total amount of diols and 90 mol-% or more based on the total amount of acid-derived constituents, respectively, makes it possible to enhance melt-mixability so that they can be melt-mixed at low temperature to obtain a mixture having a desired low temperature fixability and a good heat resistance.

Further, in the case where as the third component of the crystalline polyester resin there is incorporated an aromatic component which is an alcohol-derived constituent, the same aromatic component is preferably incorporated as a main component of the alcohol-derived constituents of the amorphous polyester resin in an amount of from 70 to 90 mol-% based on the total amount of the alcohol-derived constituents from the standpoint of melt-mixability, heat resistance and low temperature fixability.

The method for producing the aforementioned amorphous polyester resin is not specifically limited similarly to the method for producing the aforementioned crystalline polyester resin. The amorphous polyester resin can be produced by any ordinary polyester polymerization method as previously mentioned.

As the aforementioned acid-derived constituents there may be used various dicarboxylic acids exemplified with reference to crystalline polyester. As the aforementioned alcohol-derived constituents there may be used various diols. In addition to the aliphatic diols exemplified with reference to crystalline polyester, bisphenol A, bisphenol A-ethylene oxide adduct, bisphenol A-propylene oxide adduct, hydrogenated bisphenol A, bisphenol S, bisphenol S-ethylene oxide adduct, bisphenol S-propylene oxide adduct, etc. can be used. Further, from the standpoint of toner producibility, heat resistance and transparency, bisphenol S derivatives such as bisphenol S, bisphenol S-ethylene oxide adduct and bisphenol S-propylene oxide adduct are particularly preferred. The amorphous polyester resin may include a plurality of acid-derived constituents and alcohol-derived constituents. In particular, bisphenol S has an effect of enhancing the heat resistance of the polyester resin which is amorphous. From the standpoint of low temperature fixability, other third components such as bisphenol A derivative may be used as well depending on the formulation of the amorphous resin.

Common Monomer Component

In order to enhance the melt-mixability of both the crystalline polyester resin and amorphous polyester resin, it is preferred that they have alcohol-derived constituents or acid-derived constituents in common with each other.

In a preferred embodiment of the alcohol-derived constituents and acid-derived constituents of the crystalline polyester resin, the alcohol-derived constituents of the mechanical strength crystalline polyester resin include a $C_6$-$C_{12}$ straight-chain aliphatic group as a main component in an amount of from 85 to 98 mol-% based on the total amount of the alcohol-derived constituents and the acid-derived constituents of the crystalline polyester resin include an aromatic group derived from terephthalic acid, isophthalicacid or naphthalene dicarboxylic acid in an amount of 90 mol-% or more based on the total amount of the acid-derived constituents from the standpoint of low temperature fixability, heat resistance, melt-mixability and mechanical strength.

In the present embodiment, a preferred embodiment of the alcohol-derived constituents and the acid-derived constituents of the amorphous polyester resin resides in that the alcohol-derived constituents of the amorphous polyester resin include the same straight-chain aliphatic group as the $C_6$-$C_{12}$ straight-chain aliphatic group which is the main component of the crystalline polyester resin in an amount of from 10 to 30 mol-% based on the total amount of the alcohol-derived constituents and the acid-derived constituents of the amorphous polyester resin include the same aromatic group as the aromatic group derived from terephthalic acid, isophthalic acid or naphthalene dicarboxylic acid which is the main component of the acid-derived constituents of the crystalline polyester resin in an amount of 90 mol-% or more based on the total amount of the acid-derived constituents to satisfy the requirements for low temperature fixability, heat resistance and melt-mixability.

In a preferred embodiment where as the third component of the crystalline polyester resin there is incorporated an aromatic group component which is an alcohol-derived constituent, the alcohol-derived constituents of the crystalline polyester resin include a $C_6$-$C_{12}$ straight-chain aliphatic group and an aromatic diol-derived component in an amount of from 85 to 98 mol-% and from 2 to 15 mol-%, respectively, based on the total amount of the alcohol-derived constituents and the alcohol-derived constituents of the amorphous polyester resin include the same straight-chain aliphatic group and aromatic diol-derived component as the main component of the alcohol-derived constituents of the crystalline polyester resin in an amount of from 10 to 30 mol-% and from 70 to 90 mol-%, respectively, based on the total amount of the alcohol-derived constituents from the standpoint of melt-mixability, heat resistance and low temperature fixability.

Molecular Weight

In a preferred embodiment, the weight-average molecular weight of the crystalline polyester resin and the amorphous polyester resin are from 17,000 to 40,000 and from 8,000 to 16,000, respectively, from the standpoint of low temperature fixability and mechanical strength.

Melt Mixing

Mixing Ratio

In a preferred embodiment, the mixing weight ratio of the crystalline polyester resin to the amorphous polyester resin among the thermoplastic resins of the transparent toner according to the present embodiment is from 35:65 to 65:35 taking into account heat resistance, mechanical strength and melt-mixability.

Melt-Mixing Temperature/Time

Referring to a preferred embodiment of melt-mixing conditions, the crystalline polyester resin and the amorphous polyester resin are melt-mixed under the conditions such that supposing that T0 (° C.) is the temperature at which the visual reflectance Y of 20 μm thick film formed by the resin obtained by melt-mixing the crystalline polyester resin and the amorphous polyester resin for a period of time t0 (minute) is 1.5%, the melt-mixing temperature is T (° C.) and the melt-mixing time is t (minute), T (° C.) is predetermined to be from T0 to (T0+30) and t (minute) is predetermined to be from t0 to (10×t0).

In the present embodiment, it is more desirable that the temperature T (° C.) and the time t (minute) be predetermined to be from (T0+5) to (T0+10) and from t0 to (3×t0), respectively, from the standpoint of heat resistance and mechanical strength.

Visual Reflectance Y

The visual reflectance Y is explained herein below.

The term "visual reflectance Y" as used in the present embodiment is meant to indicate the visual reflectance of a film having a thickness of 20 μm formed by the polyester-based resin to be measured (resin obtained by melt-mixing a crystalline polyester resin and an amorphous polyester resin).

Figure 4:
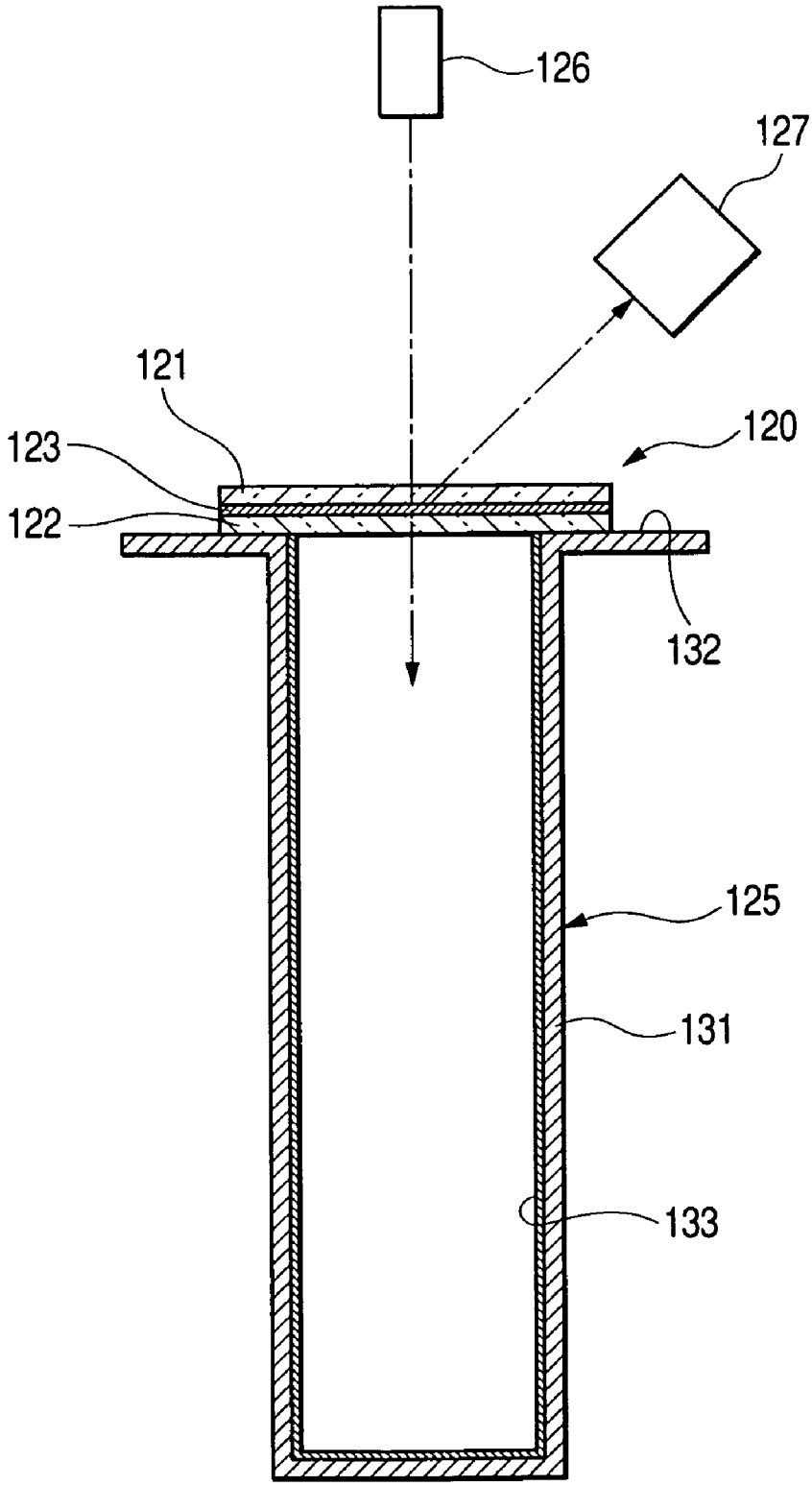
FIG. 4 is a diagram illustrating an instrument for measuring the visual reflectance which is an index of the melt-mixability of thermoplastic resin for transparent toner.

The measurement of visual reflectance Y is effected as shown in FIG. 4.

In FIG. 4, the polyester-based resin is formed into a film (preferably having a thickness of 20 μm) (The film thus obtained will be occasionally referred to as "resin film").

In order to remove scattering components from the surface and back surface of the resin film 123 to be measured, the resin film 123 is clamped between transparent cover glass sheets 121, 122 for microscope observation. The gap between the cover glass sheets 121, 122 and the resin film 123 are each then filled with a refractive index matching solution which is not shown (tetradecane).

"Subsequently, the sample 120 thus obtained (cover glass sheets 121, 122 plus resin film 123) is placed on a light trap 125. The sample 120 is then measured for reflectance by a colorimeter 127 (e.g., X-RITE 968) satisfying geometrical colorimetry conditions at 0° and 45° while being irradiated with light beam from a light source 126. As the light trap 125 there may be properly selected any one so far as it is a one-end open cylinder 131 which is provided with a resting table 132 at the open end thereof and is coated with a light-absorbing portion 133 such as black coat so that light beam transmitted by the sample 120 can be trapped."

The value Y in CIE XYZ color specification system corresponds to visual reflectance Y. When the resin film 123 to be measured is transparent and the cover glass sheets 121, 122 are transparent, Y is substantially zero. In other words, the value Y corresponds to the intensity of the scattering components in the resin film 123.

In the case where a polyester-based resin such as ordinary crystalline polyester resin which becomes milky due to the growth of crystal (spherulite) and polyester-based resin which has been subjected to crystal dispersion by melt mixing or copolymerizable components but lacks dispersibility is measured, the crystal dispersion of the resin causes rise of scattering intensity resulting in the rise of visual reflectance Y.

On the other hand, the finer the crystal dispersion of the polyester-based resin developed by melt mixing or copolymerizable components such as bisphenol S is, the smaller is the visual reflectance Y. Accordingly, the visual reflectance Y is an index of the size of crystal dispersion.

It goes without saying that the thickness of the resin film 123 to be measured is preferably 20 μm accurately. However, in the case where percent scattering is 2% or less, the visual reflectance Y is substantially proportional to the thickness of the resin film 123. Therefore, even when the thickness of the resin film 123 is not accurately 20 μm, the visual reflectance Y may be calculated in terms of thickness.

The method for preparing the resin film 123 to be measured is not specifically limited so far as the aim of forming a homogeneous film having a uniform thickness cannot be failed. For example, the polyester resin to be measured may be melted and spread on a substrate having a smooth top surface and a good releasability placed on a shallow pan such as hot plate using an erichsen or bar coater. The film thus formed is then peeled off the substrate to obtain the resin film to be measured.

Alternatively, a film formed on a proper substrate may be superposed on a transparent film such as PET film. The laminate is then heated under pressure. The substrate is then peeled off the laminate. The film superposed on the transparent film is used as the sample 120 which is then measured for visual reflectance Y. In this case, the reflectance Y0 of the transparent film itself is subtracted from the measured visual reflectance Yt of the sample 120 to determine the visual reflectance Y of the resin film 123 to be measured.

Other Components

The transparent toner of the present embodiment includes the aforementioned binder resin as an essential constituent. The transparent toner may also include other components which can be used in known ordinary transparent toners as necessary. The other components to be used herein are not specifically limited and may be properly selected depending on the purpose. Examples of the other components employable herein include various known additives such as inorganic particulate material, organic particulate material, charge controller and releasing agent.

The aforementioned inorganic particulate material is normally used for the purpose of enhancing the fluidity of the toner. Examples of the inorganic particulate material employable herein include particulate silica, particulate alumina, particulate titanium oxide, particulate barium titanate, particulate magnesium titanate, particulate calcium titanate, particulate strontium titanate, particulate zinc oxide, borax, clay, mica, wollastonite, diatomaceous earth, cerium chloride, red oxide, chromium oxide, cerium oxide, antimony trioxide, magnesium oxide, zirconium oxide, silicon carbide and silicon nitride. Preferred among these inorganic particulate materials is particulate silica, particularly hydrophobicized particulate silica.

The average primary particle diameter (number-average particle diameter) of the aforementioned inorganic particulate material is preferably from 1 to 1,000 nm. The amount of the inorganic particulate material to be (externally) added is preferably from 0.01 to 20 parts by weight based on 100 parts by weight of the transparent toner.

The aforementioned organic particulate material is normally used for the purpose of enhancing cleanability and transferability. Examples of the organic particulate material employable herein include particulate polystyrene, particulate polymethyl methacrylate, and particulate polyvinylidene fluoride.

The aforementioned charge controller is normally used for the purpose of enhancing chargeability. Examples of the charge controller employable herein include metal salt of salicylic acid, metal-containing azo compound, nigrosine, and quaternary ammonium salt.

The aforementioned releasing agent is normally used for the purpose of enhancing releasability. Specific examples of the releasing agent employable herein include low molecular polyolefins such as polyethylene, polypropylene andpolybutene, silicones having a heat softening point, aliphatic acid amides such as oleic acid amide, erucic acid amide, ricinoleic acid amide and stearic acid amide, vegetable-based waxes such as carnauba wax, rice wax, candelilla wax, Japan wax and jojoba oil; animal waxes such as beeswax, mineral/petroleum waxes such as montan wax, ozokerite, ceresin, paraffin wax, microcrystalline wax and Fischer-Tropsch wax, and ester-based waxes such as aliphatic acid ester, montanic acid ester and carboxylic acid ester. In the present embodiment, these releasing agents may be used singly or in combination of two or more thereof.

The amount of these releasing agents to be added is preferably from 0.5 to 50% by weight, more preferably from 1 to 30% by weight, more preferably from 5 to 15% by weight based on the total weight of the transparent toner. When the amount of the releasing agents to be added falls below 0.5% by weight, the effect of releasing agent cannot be exerted. On the contrary, when the amount of the releasing agents to be added exceeds 50% by weight, the chargeability can be easily affected or the toner can be easily destroyed inside the developing unit, causing the releasing agent to be spent for carrier and hence deteriorating chargeability. Further, the releasing agent can be insufficiently oozed to the surface of the image during fixing and thus can be easily left in the image, deteriorating transparency.

The transparent toner of the present embodiment may be covered by a surface layer. The surface layer preferably doesn't affect the dynamic properties and melt viscoelastic properties of the entire toner. For example, when the toner is covered by a thick non-melting or high melting surface layer, the low fixability attained by the use of the crystalline polyester resin cannot be sufficiently exhibited.

Accordingly, the thickness of the surface layer is preferably small, preferably from 0.001 to 0.5 μm.

In order to form the aforementioned thin surface layer, a method involving chemical treatment of the surface of particles including a binder resin, a coloring agent, and optionally inorganic particulate material and other materials is preferably used.

Examples of the components constituting the surface layer include silane coupling agents, isocyanates, and vinyl monomers. These components preferably have a polar group incorporated therein. The chemical bonding of a polar group to the components makes it possible to raise the bonding strength of the toner to transferring material such as paper.

The polar group may be any polar group so far as it is a polarizing functional group. Examples of the polar group employable herein include carboxyl groups, carbonyl groups, epoxy groups, ether groups, hydroxyl groups, amino groups, imino groups, cyano groups, amide groups, imide groups, ester groups, and sulfone groups.

Examples of the chemical treatment method employable herein include method involving the oxidation by a strong oxidizing material such as peroxide, ozone oxidization or plasma oxidization, and method involving the bonding of a polymerizable monomer having a polar group by graft polymerization. The chemical treatment causes the polar group to be firmly bonded to the molecular chain of the crystalline resin covalently.

In the present embodiment, a chargeable material may be chemically or physically attached to the surface of the particulate toner. Alternatively, a particulate material such as particulate metal, metal oxide, metal salt, ceramic, resin and carbon black may be externally added for the purpose of enhancing chargeability, electrical conductivity, powder fluidity, lubricity, etc.

Physical Properties of Toner

In the transparent toner of the present embodiment, the temperature Tα at which the viscosity of the entire transparent toner is $10^3$ Pa·s is preferably from 70° C. to 110° C. When the temperature Tα is less than 70° C., the resulting transparent toner cannot exhibit a sufficient heat resistance and, when allowed to stand at high temperature, can undergo troubles such as blocking. On the contrary, when the temperature Tα is more than 110° C., it is occasionally made difficult to obtain an image having a smooth surface and a high glossiness by fixing. In particular, a step can be left on the border of high density area with low density area on the surface of fixed image.

The volume-average particle diameter of the transparent toner of the present embodiment is preferably from 6.0 μm to 16.0 μm, more preferably from 12.0 μm to 16.0 μm. If necessary, the transparent toner particles may be subjected to classification by an air classifier or the like to give a sharp distribution of particle size.

"The volume-average particle diameter can be measured by a type TA-II COULTER COUNTER (produced by Coulter Inc.) at an aperture diameter of 50 μm. In some detail, measurement is effected after 30 seconds or more of ultrasonic dispersion of the toner to be measured in an aqueous solution of electrolyte (aqueous solution of Isoton)."

Other Elements

It is a prerequisite that the transparent toner of the present embodiment is adapted to be transferred and fixed on or around a color toner image formed on the surface of a recording medium with a color toner including at least a thermoplastic resin and a coloring agent by an electrophotographic process.

The aforementioned color toner is not specifically limited so far as it is an ordinary color toner including at least a thermoplastic resin and a coloring agent. As additives other than the thermoplastic resin and coloring agent there may be internally or externally added the same additives as exemplified with reference to the column <Other components> in the transparent toner of the present embodiment.

As the aforementioned thermoplastic resin there may be used any known resin without limitation. Specific examples of the thermoplastic resin employable herein include polyester resins, styrene/acrylic copolymers, and styrene-butadiene copolymers.

As the aforementioned coloring agent there may be used any known coloring agent without limitation. Examples of yellow (Y) coloring agents employable herein include benzidine yellow, quinoline yellow, and hanza yellow. Examples of magenta (M) coloring agents employable herein include rhodamine B, rose bengal, and pigment red. Examples of cyan (C) coloring agents employable herein include phthalocyanine blue, aniline blue, and pigment blue. Examples of black (K) coloring agents employable herein include carbon black, aniline black, and blend of color pigments.

An ordinary color toner includes a particulate material having a volume-average particle diameter of from 1 μm to 15 μm (normally referred to as "particulate toner" or "colored particles") dispersed in the aforementioned binder resin having a particulate external additive having an average particle diameter of from 5 to 100 nm such as inorganic particulate material (e.g., silicon oxide, titanium oxide, aluminum oxide) and particulate resin (e.g., polymethyl methacrylate (PMMA), polyvinyl difluoride (PVDF)) attached thereto.

The method for producing the particulate toner constituting the color toner is not specifically limited. A knead grinding method may be used besides the aforementioned various wet process methods exemplified with reference to the transparent toner of the present embodiment. It goes without saying that since the color toner has a relatively low viscosity, a wet process production method is preferred as in the transparent toner of the present embodiment.

Method for Producing Toner

As the method for producing the transparent toner of the present embodiment there is preferably employed a wet process because the materials can be difficultly ground. Known examples of the wet process include submerged drying method, emulsion flocculation method, melt suspension method, and solution suspension method. Preferred among these wet processes are melt suspension method and emulsion flocculation method, which are free from organic solvent, from the standpoint of environmental burden and safety. From the standpoint of action of transparent toner of laminating a color toner image, melt suspension method, which can provide a great particle size more easily than emulsion flocculation method, is more desirable because the developed amount, developer fluidity and chargeability are more important than resolution.

In order to obtain the suspended or emulsified particles of the polyester resin in an aqueous system free from solvent in a practicable yield, it is necessary that an ionic hydrophilic group derived from sulfonic acid be introduced into the molecular structure of the polyester resin or a large amount of a dispersing aid or surface active agent be used, occasionally leaving something to be desire in charge ability and environmental safety of the resulting toner.

The polyester resin to be used in the transparent toner of the present embodiment preferably includes a hydrophilic group derived from bisphenol S incorporated therein. Since bisphenol S has a high affinity for water, the amount of the dispersing aid to be used in melt suspension in an aqueous phase can be reduced. Further, the aforementioned hydrophilic group is nonionic, the resulting toner exhibits a high environmental safety and thus is advantageous in both wet granularity in aqueous phase and toner chargeability.

As an example of the method for producing the transparent toner of the present embodiment there will be described a production method involving melt suspension.

The aforementioned melt suspension method includes at least a dispersion suspension step of dispersion-suspending a polymer mainly composed of polyester resin in an aqueous dispersion medium using an emulsifier equipped with a rotary blade to prepare a dispersion suspension having particles formed therein.

At the dispersion suspension step, the aforementioned polymer is dispersed in the aqueous dispersion medium using a dispersing machine. The dispersion is heated to have a lowered viscosity while being given a shearing force to obtain a suspension of polymer (dispersion of particles). Examples of the aforementioned dispersing machine include homogenizer, homomixer, pressure kneader, extruder, and media disperser.

The dispersion of particles thus obtained is then subjected to the aforementioned solid-liquid separation step involving filtration or the like to separate dispersed particles from the dispersion. The dispersed particles are optionally subjected to cleaning or drying to produce a particulate toner.

At the aforementioned dispersion suspension step, a dispersant may be used to stabilize the suspension or thicken the aqueous dispersion medium. Examples of the dispersant employable herein include water-soluble polymers such as polyvinyl alcohol, methyl cellulose, ethyl cellulose, hydroxyethyl cellulose, carboxymethyl cellulose, sodium polyacrylate and sodium polymethacrylate.

Transparent Developer

The transparent toner of the present embodiment as described above may be used as it is in the form of one-component developer or may be used as a toner for two-component developer including a carrier and a toner. The two-component developer (hereinafter simply referred to as "transparent developer") will be further described hereinafter.

The carrier which can be incorporated in the transparent developer of the present embodiment is not specifically limited. Any known carrier may be used regardless of whether or not it is colored. For example, a resin-coated carrier including a core having a resin coat layer provided thereon may be used. Alternatively, a resin-dispersed carrier having an electrically-conductive material dispersed in a matrix resin may be used.

Examples of the coating resin or matrix resin to be used in the carrier include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, straight silicone resin including an organosiloxane bond, modification product thereof, fluororesin, polyester, polycarbonate, phenolic resin, and epoxy resin. However, the invention is not limited to these resins.

Examples of the electrically-conductive material employable herein include metal such as gold, silver and copper, carbon black, titanium oxide, zinc oxide, barium sulfate, aluminumborate, potassiumtitanate, tinoxide, and carbon black. However, the invention is not limited to these electrically-conductive materials.

Examples of the core of carrier employable herein include magnetic metal such as iron, nickel and cobalt, magnetic oxides such as ferrite and magnetite, and glass bead. In order to use the carrier in a magnetic brushing method, the core material is preferably a magnetic material.

The volume-average particle diameter of the core of carrier is normally from 10 μm to 500 μm, preferably from 30 μm to 100 μm.

In order to coat the surface of the core of carrier with a resin, a method involving the spreading of a coat layer-forming solution having the aforementioned coat resin and optionally various additives dissolved in a proper solvent may be employed. The solvent for the coating solution is not specifically limited. A proper solvent may be selected taking into account the coat resin used, coatability, etc.

Specific examples of the resin coating method employable herein include dipping method involving the dipping of the carrier core in the coat layer-forming solution, spraying method involving the spraying of the coat layer-forming solution over the surface of the carrier core, fluidized bed method involving the spraying of the coat layer-forming solution over the carrier core suspended in air stream, and kneader coater method which includes mixing the carrier core and the coat layer-forming solution in a kneader coater, and then removing the solvent from the mixture.

In the present embodiment, the mixing ratio of the transparent toner to the carrier in the transparent developer (by weight) is preferably from about 1:100 to 30:100, more preferably from about 3:100 to 20:100.

Image Forming Device

The image forming device of the present embodiment will be further described hereinafter.

In FIG. 2, as an imaging unit 30 there is used any known electrophotographic toner image forming device.

For example, the image forming device preferably includes a drum-shaped or belt-shaped photoreceptor, a charging unit disposed opposed to the photoreceptor, an image signal forming unit for controlling an image signal for forming a color image, an exposure unit for imagewise exposing the photoreceptor with the image signal from the image signal forming unit to form a latent image, a developing unit for developing the latent image on the surface of the photoreceptor with a developer layer containing a color toner to obtain a toner image, and a transferring unit for transferring the toner image formed on the surface of the photoreceptor onto a recording medium.

In another preferred arrangement, an intermediate transferring material is provided so that the toner image on the photoreceptor can be transferred onto the intermediate transferring material from which the toner image is then transferred onto the surface of the recording medium by a secondary transferring unit.

The aforementioned photoreceptor is not specifically limited. Any known photoreceptor may be used without problem. The photoreceptor may have a single layer structure or may have a function-separation type multi-layer structure. The material of the photoreceptor may be an inorganic photoreceptor such as selenium and amorphous silicon or an organic photoreceptor (so-called OPC)

As the aforementioned charging unit there may be used, e.g., a triboelectric charging unit including an electrically-conductive or semiconductive roll, brush, film or rubber blade, a non-contact type charging unit such as corotron charger and scorotron charger utilizing corona discharge or other means which are known per se.

As the aforementioned exposure unit there may be used any known exposure unit such as combination of semiconductor laser and scanning device, laser ROS including an optical system and LED head. In order to realize a preferred embodiment allowing the formation of a uniform exposure image having a high resolution, laser ROS or LED head is preferred.

As the aforementioned image signal forming unit there may be used any known unit so far as a signal allowing the formation of a toner image in a desired position on the surface of the recording medium can be generated.

As the aforementioned developing unit there may be used any known developing unit regardless of if it is of one-component type or two-component type so far as it is capable of forming a uniform toner image having a high resolution as a latent image on the surface of the aforementioned photoreceptor. The two-component type developing unit is preferred because it can realize reproduction of smooth tone having a good graininess.

As the aforementioned transferring unit there may be used any known unit such as unit capable of forming an electric field between the photoreceptor and the recording medium or the intermediate transferring material using an electrically-conductive or semiconductive roll, brush, film or rubber blade and transferring a toner image made of charged toner particles and unit capable of corona-charging the back surface of a recording medium or intermediate transferring material using a corotron charger or scorotron charger utilizing corona discharge and transferring a toner image made of charged toner particles.

As the aforementioned intermediate transferring material there may be used an insulating or semiconductive belt-shaped material or a drum-shaped material having an insulating or semiconductive surface. The semiconductive belt-shaped material is preferred because it can maintain its transferring properties invariably during continuous image formation and allows the use of a small-sized device. As such a belt-shaped material there is known a resin material having an electrically-conductive filler such as carbon fiber dispersed therein. As such a resin material there is preferably used a polyimide resin.

As the aforementioned secondary transferring unit there may be used any known unit such as unit capable of forming an electric field between the intermediate transferring material and the recording medium using an electrically-conductive applied the voltage or semiconductive roll, brush, film or rubber blade and transferring a toner image made of charged toner particles and unit capable of corona-charging the back surface of intermediate transferring material using a corotron charger or scorotron charger utilizing corona discharge and transferring a toner image made of charged toner particles.

The fixing unit 40 may be properly selected. However, the fixing unit 40 preferably includes a belt-shaped fixing member (fixing belt 41), a heat-pressing unit for heat-pressing the image on the recording medium 11 using the belt-shaped fixing member and a cooling/peeling unit for cooling and peeling the substrate after heat-pressing.

The belt-shaped fixing member may be made of a polymer film such as polyimide. Preferably, the resistivity of the belt-shaped fixing member is adjusted by dispersing an electrically-conductive additive such as electrically-conductive particulate carbon and electrically-conductive polymer in the material of the belt-shaped fixing member. The shape of the fixing member is not limited to endless shape. For example, the fixing member may be in the form of web or sheet that can be properly fed and wound on the other side. However, the endless belt-shaped fixing member is preferred. From the standpoint of peelability or surface properties, the surface of the belt is coated with a silicon resin and/or fluororesin. Further, the glossiness of the surface of the belt-shaped fixing member is preferably 60 or more as measured by a 75 degree gloss meter (produced by MURAKAMI COLOR RESEARCH LABORAT0RY) from the standpoint of smoothness.

As the aforementioned heat-pressing unit there may be used any known heat-pressing unit.

For example, there may be used one capable of driving the belt-shaped fixing member and the recording medium 11 having an image formed thereon while being clamped between a pair of rolls which are driven at a constant speed.

In this arrangement, one or both of the two rolls have a heat source provided therein so that the surface thereof is heated to a temperature at which the transparent toner is melted. Further, the two rolls are brought into contact with each other under pressure. Preferably, one or both of the two rolls have a silicon rubber or fluororubber layer provided on the surface thereof. The length of the area to be heat-pressed is preferably from about 1 mm to 8 mm.

As the aforementioned cooling/peeling unit there may be used one capable of peeling the recording medium 11 by a peeling member after cooling the recording medium 11 which has been heat-pressed by the belt-shaped fixing member.

As the cooling means there may be used spontaneous cooling. From the standpoint of size of device, a cooling member such as heat sink and heat pipe is preferably used to raise the cooling rate. The peeling member is preferably arranged such that a peeling nail is inserted into the gap between the belt-shaped fixing member and the recording medium 11 or a roll having a small radius of curvature (peeling roll) is provided at the peeling position to peel the recording medium.

As the conveying unit 50 for conveying the recording medium 11 to the fixing unit 40 there may be used a conveying unit which is known per se.

The conveying speed is preferably kept constant. To this end, a unit capable of driving the aforementioned recording medium 11 clamped between a pair of rubber rolls rotating at a constant speed or a unit capable of driving the aforementioned recording medium 11 at a constant speed on a belt made of rubber or the like wound on a pair of rolls one of which is rotated by a motor or the like at a constant speed may be used.

In particular, in the case where an unfixed toner image has been formed, the latter unit is preferably used to avoid disturbance of the toner image.

The present embodiment is characterized in that as one element of the imaging unit 30 there is provided on the belt-shaped fixing member (fixing belt 41) of the fixing unit 40 a gloss-providing unit (transparent toner image forming unit) 60 for forming a transparent toner image by the transparent toner.

In the present embodiment, the belt-shaped fixing member (fixing belt 41) of the fixing unit 40 also acts as a member for supporting the transparent toner image and thus needs to be capable of supporting the fixed and transparent toner images thereon.

As the gloss-providing unit 60 there may be properly used electrophotographic imaging engines and developing units which are known per se as far as the purpose of forming a transparent toner image on the belt-shaped fixing member can be accomplished.

Referring to the use of a developing unit by way of example, a one-component developing unit or two-component developing unit may be disposed opposed to a grounded or bias voltage-applied counter electrode member in the form of roll or the like at the position where the counter electrode member comes in contact with the back surface of the belt-shaped fixing member so that the transparent toner image can be developed directly on the surface of the belt-shaped fixing member. In this case, the temperature of the aforementioned belt-shaped fixing member at the position on the device where the transparent toner image is directly developed is preferably 60° C. or less.

While the present embodiment has been described with reference to the case where the belt-shaped fixing member (fixing belt 41) is used as a member for supporting transparent toner image, it goes without saying that a separate member for supporting transparent toner image may be provided before the fixing unit 40.

Specific Configuration

The image forming device shown in FIG. 2 will be further described hereinafter.

In FIG. 2, the imaging unit 30 includes a charger which is not shown, an exposure unit 33 for exposure-scanning an original 32 to form an electrostatic latent image on a photoreceptor drum 31, a rotary developing unit 34 having developing units 34*a* to 34*d* receiving yellow, magenta, cyan and black color toners and a transparent toner mounted thereon, an intermediate transferring belt 35 for temporarily retaining the image on the photoreceptor drum 31 and a cleaning unit (not shown) for removing residual toner on the photoreceptor drum 31 provided on the periphery of a photoreceptor 31. There is provided a primary transferring unit (e.g., transferring corotron) 36 at the position on the aforementioned intermediate transferring belt 35 opposed to the photoreceptor drum 31. Further, a secondary transferring unit 37 (one including a pair of transferring rolls 37*a* clamping the intermediate transferring belt 35 and the recording medium 11 and a backup roll 37*b* in this embodiment) is provided at the position on the intermediate transferring belt 35 by which the recording medium 11 passes.

"The exposure unit 33 is arranged such that the original 32 is irradiated with light beam from an illumination lamp 331 to reflect light beam from the original 32 which is subjected to color separation by a color scanner 332, image-processed by an image processor 333 and then emitted as electrostatic latent image-drawing light beam onto the photoreceptor drum 31 at exposure point via, e.g., a laser diode 334 and an optical system 335."

The fixing unit 40 includes a fixing belt 41 (e.g., belt-shaped material coated with a silicon rubber) 41 extending over a proper number (3 in this embodiment) of tension rollers 42 to 44, a heated roll 42 arranged to heat the tension roll disposed on the delivery side of the fixing belt 41, a peeling roll 44 arranged such that the recording medium 11 can be peeled off the tension roll disposed on the discharge side of the fixing belt 41, a pressure roll 46 (which may be provided with a heat source as necessary) disposed in pressure contact with the fixing belt 41 opposed to the heated roll 42 in such an arrangement that the fixing belt 41 is clamped therebetween and a heat sink 47 which is disposed inside the fixing belt 41 as a cooling member for cooling the fixing belt 41 between the heated roll 42 and the peeling roll 44.

In a specific example of the present embodiment, the width of the nip between the heated roll 42 and the pressure roll 46 is 8 mm for example. The driving speed of the fixing belt 41 is 30 mm/sec. for example. As the fixing belt 41 there may be used a 80-μm thick endless film made of a thermoplastic polyimide coated with a silicon rubber layer on the outer surface thereof to a thickness of 30 μm.

Between the fixing unit 40 and the image forming site on the imaging unit 30 is provided a conveying unit 50 including, e.g., conveying belt.

Further, in the present embodiment, as the gloss-providing unit 60 there may be used, e.g., an imaging engine employing an electrophotographic process. In some detail, the gloss-providing unit 60 includes a photoreceptor drum 61, a charging unit 62 for uniformly charging the surface of the photoreceptor drum 61, an exposure unit 63 made of ROS or LED array for exposing the surface of the photoreceptor drum 61 to form a latent image, a transparent toner image forming unit 64 for controlling the region on the surface of the recording medium 11 where a transparent toner image is formed and the amount of the transparent toner image thus formed, a transparent toner image developing unit 65 disposed opposed to the photoreceptor drum 61 for developing the latent image on the surface of the photoreceptor drum 61 with a developer layer containing a transparent toner to obtain a transparent toner image and a transferring unit 66 for transferring the transparent toner image on the surface of the photoreceptor drum 61 onto the surface of the fixing belt 41 which is a transparent toner image carrier.

As the photoreceptor drum 61 there may be used any known photoreceptor drum without any special limitation. The photoreceptor drum 61 may have a single layer structure or may have a function-separation type multi-layer structure. The material of the photoreceptor drum 61 may be an inorganic photoreceptor such as selenium and amorphous silicon or an organic photoreceptor (so-called OPC).

As the charging unit 62 there may be used, e.g., a triboelectric charging unit including an electrically-conductive or semiconductive roll, brush, film or rubber blade, a non-contact type charging unit such as corotron charger and scorotron charger utilizing corona discharge or other means which are known per se.

As the exposure unit 63 there may be used any known exposure unit such as combination of semiconductor laser, scanning device, laser ROS including an optical system, LED head and halogen lamp. In order to realize a preferred embodiment allowing desired change of region of exposure image, i.e., position on the surface of the recoding medium 11 where a transparent toner image is formed, laser ROS or LED head is preferred.

As the transparent toner image signal forming unit 64 there may be used any known unit so far as a signal allowing the formation of a transparent toner image in a desired position on the surface of the recording medium 11 can be generated. The transparent toner image signal forming unit 64 may be also arranged such that a transparent toner image forming signal is generated according to image data outputted from the image processor in the existing toner image forming unit.

As the transparent toner image developing unit 65 there may be used any known developing unit regardless of if it is of one-component type or two-component type so far as it is capable of forming a uniform transparent toner image on the surface of the photoreceptor drum 61.

As the transferring unit 66 there may be used any known unit such as unit capable of forming an electric field between the photoreceptor drum 61 and the fixing belt 41 using an electrically-conductive or semiconductive roll, brush, film or rubber blade to which a voltage is applied and transferring the charged transparent toner particles and unit capable of corona-charging the back surface of the fixing belt 41 using a corotron charger or scorotron charger utilizing corona discharge and transferring the charged toner particles.

The region where the transparent toner image is formed is the entire region on the image area covering the entire color toner image on the surface of the recording medium 11 in the present embodiment, but the invention is not limited thereto. For example, the region where the transparent toner image is formed may be the entire surface of the recording medium 11. Alternatively, only the region requiring photographic image quality, particularly high glossiness among the color toner image maybe selected. Further, little or no transparent toner image may be formed on the color toner image. For example, in order to inhibit the occurrence of unevenness on the color toner image due to toner particles, the height of the toner layer of the transparent toner image may be changed to uniformalize the height of the image according to the height of the toner layer of the color toner image or a transparent toner image may be formed only on the region where no color toner image has been formed. Further, a transparent toner image may be formed prior to the formation of the color toner image. The term "on or around the color toner image" as defined herein includes all these embodiments.

The operation of the image forming device according to the present embodiment will be described hereinafter.

In order to obtain a color duplicate using the image forming device according to the present embodiment, an original 32 to be duplicated is irradiated with light beam from the illumination lamp 331 as shown in FIG. 2. The light beam reflected by the original 32 is then subjected to color separation by a color scanner 332. The light beam thus color-separated is then image-processed by the image processor 333 so that it is color-corrected to obtain a plurality of color toner image data and a transparent toner image data which are then modulated by a laser diode 334 by colors to generate modulated laser beams.

The photoreceptor drum 31 is then irradiated with each of these laser beams by a plurality of times to form a plurality of electrostatic latent images thereon. The plurality of electrostatic latent images are then sequentially developed with four color toners of yellow, magenta, cyan and black by a yellow developing unit 34*a*, a magenta developing unit 34*b*, a cyan developing unit 34*c* and a black developing unit 34*d*, respectively.

The color toner images thus developed are then sequentially transferred from the photoreceptor drum 31 onto the intermediate transferring belt 35 by the primary transferring unit (transferring corotron) 36. The transparent toner image and the four color toner images which have thus been transferred onto the intermediate transferring belt 35 are then transferred onto the recording medium 11 at a time by the secondary transferring unit 37.

Thereafter, the recording medium 11 having the color toner image 12 formed thereon is conveyed to the fixing unit 40 through the conveying unit 50 as shown in FIG. 5.

The operation of the fixing unit 40 and the gloss-providing unit 60 will be described hereinafter.

Both the heated roll 42 and the pressure roll 46 are previously heated to the melting temperature of the toner. A load of 100 kg is developed between the two rolls 42, 46. The two rolls 42, 46 are rotationally driven. The driving of the rolls 42, 46 is accompanied by the driving of the fixing belt 41.

In synchronization with the conveyance of the recording medium 11, the photoreceptor drum 61, which is the transparent toner image carrier for the gloss-providing unit 60, is rotated while the charging unit (e.g., charging roll) 62 is being given a bias voltage. In this manner, the photoreceptor drum 61 is uniformly charged. The photoreceptor drum 61 is then exposed to light according to an image signal from the transparent toner image signal forming unit 64 in the exposure unit 63.

Figure 5A:
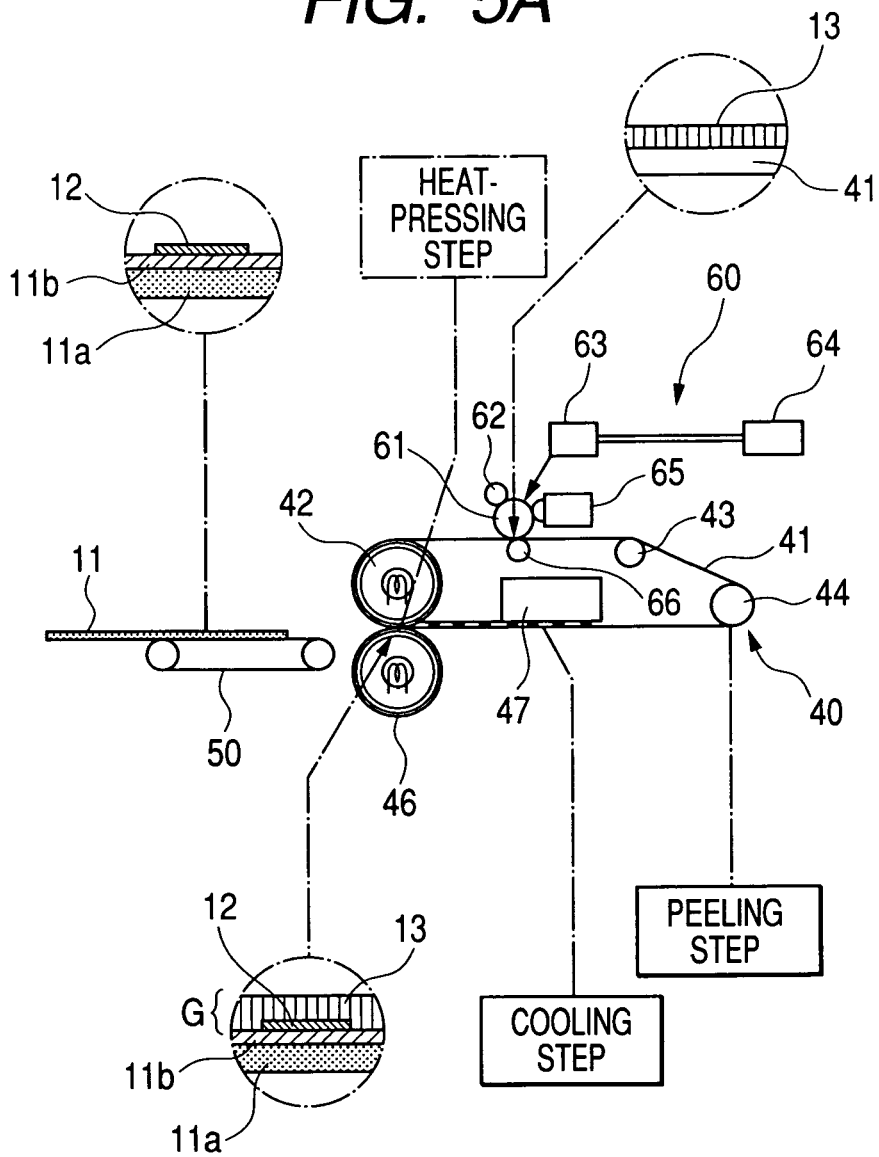
FIG. 5A is a diagram illustrating the imaging process according to the present embodiment of implementation of the invention.

At this point, the exposed area has a lowered potential. This area is then developed in the transparent toner image developing unit 65. Thereafter, the transparent toner image 13 on the photoreceptor drum 61 is transferred onto the fixing belt 41 by the transferring unit (transferring roll) 66 to which a bias voltage has been applied as shown in FIG. 5A.

Then, the fixing belt 41 onto which the transparent toner image 13 has been transferred comes in contact with the surface of the recording medium 11 having the color toner image 12 formed thereon at the nip between the heated roll 42 and the pressure roll 46 so that the color toner image 12 and the transparent toner image 13 are heated and melted (heat-pressing step).

Figure 5B:
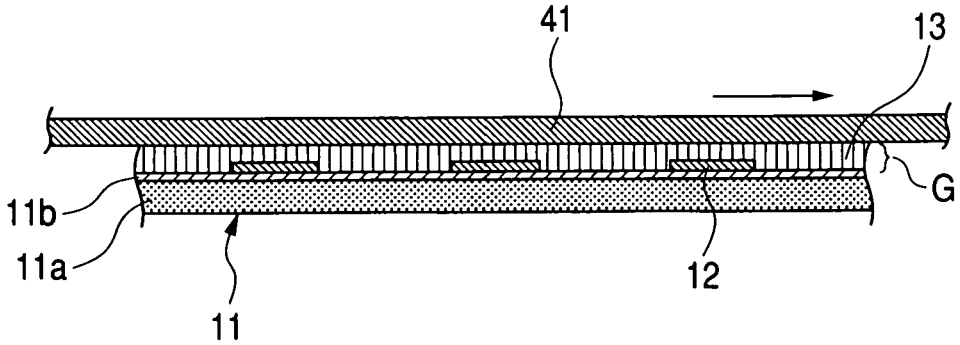
FIG. 5B is a diagram illustrating the fixing process by the fixing unit.

Under these conditions, the moment the color toner image 12 which has been introduced opposed to the heated roll 42 is heated and melted on the surface of the recording medium 11, the transparent toner image 13 which has been formed on the surface of the fixing belt 41 is heated and melted on or around the color toner image 12 to cover the entire color toner image 12 as shown in FIG. 5B.

Thereafter, the color toner image 12 and the transparent toner image 13 are heated and melted at a temperature of from about 120° C. to 130° C. at the pressure contact area (nip) between the heated roll 42 and the pressure roll 46. The recording medium 11 having the transparent toner image 12 and the color toner image 13 fused thereto is then conveyed in the direction indicated by the arrow together with the fixing belt 41 while the transparent toner image 13 being kept in close contact with the surface of the fixing belt 41. During this procedure, the fixing belt 41 is forcedly cooled by the cooling heat sink 47 (cooling step) so that the transparent toner image 13 and the color toner image 12 are cooled and solidified. The recording medium 11 is then peeled off the fixing belt 41 due to its nerve (rigidity) by the peeling roll 44 (peeling step).

In this manner, a color image G having a high glossiness is formed on the recording medium 11.

The surface of the fixing belt 41 which has finished with the peeling step is then optionally cleaned by a cleaner which is not shown to remove residual toner, etc. to prepare for the subsequent fixing step.

Embodiment 2

Figure 6:
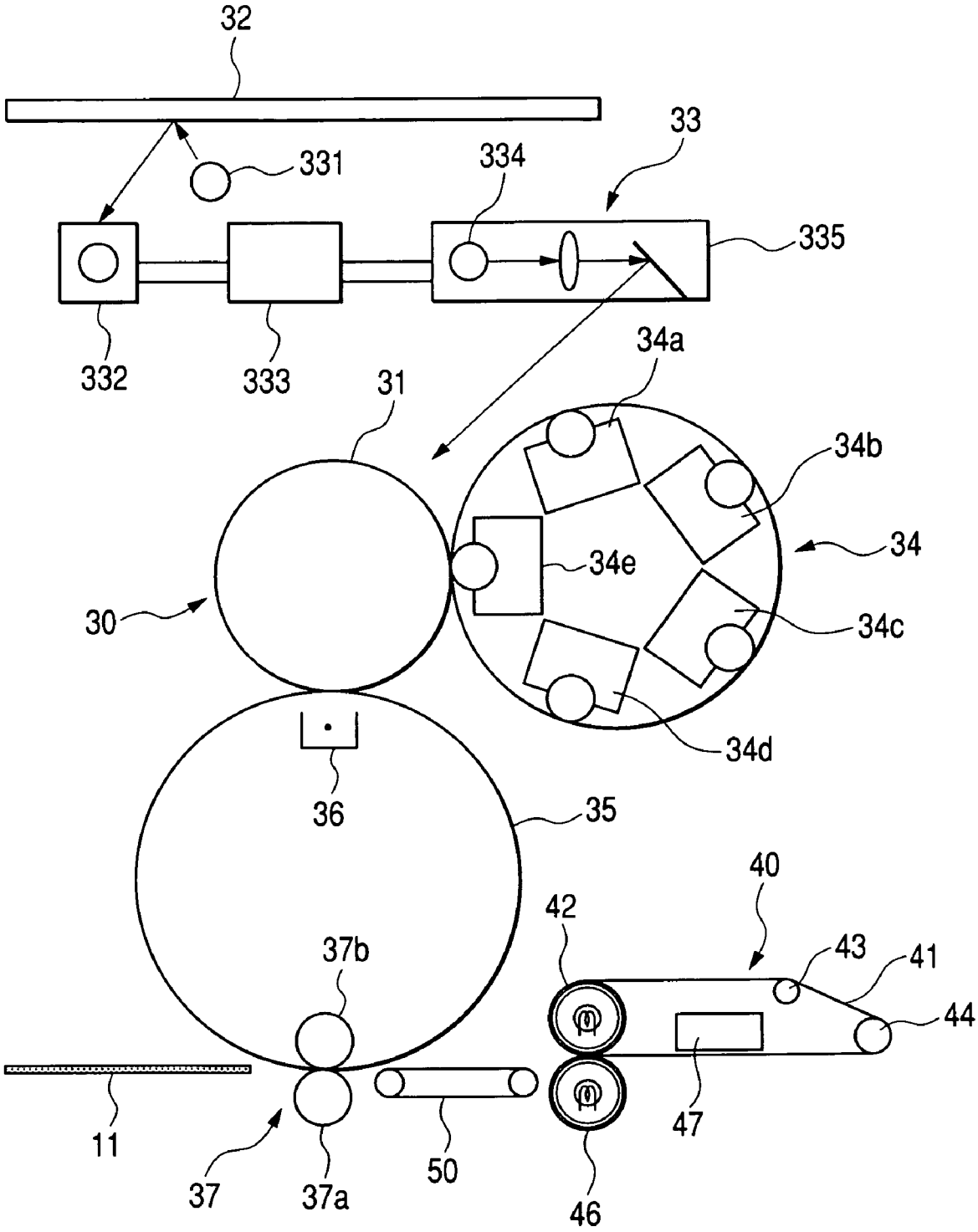
FIG. 6 is a diagram illustrating the general configuration of the image forming device used in the embodiment 2.

FIG. 6 illustrates the embodiment 2 of the color image forming device to which the invention is applied.

In FIG. 2, the color image forming device includes an imaging unit 30 for forming a photographic image including a color toner image and a transparent toner image, a fixing unit 40 for fixing the various toner image formed on the recording medium 11 by the imaging unit 30 and a conveying unit 50 for conveying the recording medium 11 having an image formed thereon onto the fixing unit 40. Unlike the embodiment 1, the imaging unit 30 includes a transparent toner developing unit 34*e* provided as a gloss-providing unit inside the rotary developing unit 34 instead of the gloss-providing unit 60 for forming a transparent toner image on the fixing belt 41. Where the constituents are the same as those of the embodiment 1, the same numerals and signs are used. These constituents will not be described in detail.

The operation of the color image forming device according to the present embodiment will be described hereinafter.

In order to obtain a color duplicate using the image forming device according to the present embodiment, an original 32 to be duplicated is irradiated with light beam from the illumination lamp 331 as shown in FIG. 6. The light beam reflected by the original 32 is then subjected to color separation by a color scanner 332. The light beam thus color-separated is then image-processed by the image processor 333 so that it is color-corrected to obtain a plurality of color toner image data and a transparent toner image data which are then modulated by a laser diode 334 by colors to generate modulated laser beams.

The photoreceptor drum 31 is then irradiated with each of these laser beams several times to form a plurality of electrostatic latent images thereon. The plurality of electrostatic latent images are then sequentially developed with the transparent toner and four color toners of yellow, magenta, cyan and black by a transparent toner developing unit 34*e*, a yellow developing unit 34*a*, a magenta developing unit 34*b*, a cyan developing unit 34*c* and a black developing unit 34*d*, respectively.

The color toner images thus developed are then sequentially transferred from the photoreceptor drum 31 onto the intermediate transferring belt 35 by the primary transferring unit (transferring corotron) 36. The transparent toner image and the four color toner images which have thus been transferred onto the intermediate transferring belt 35 are then transferred onto the recording medium 11 at a time by the secondary transferring unit 37. At this point, the transparent toner image is formed covering the various color toner images or the periphery thereof.

Figure 7:
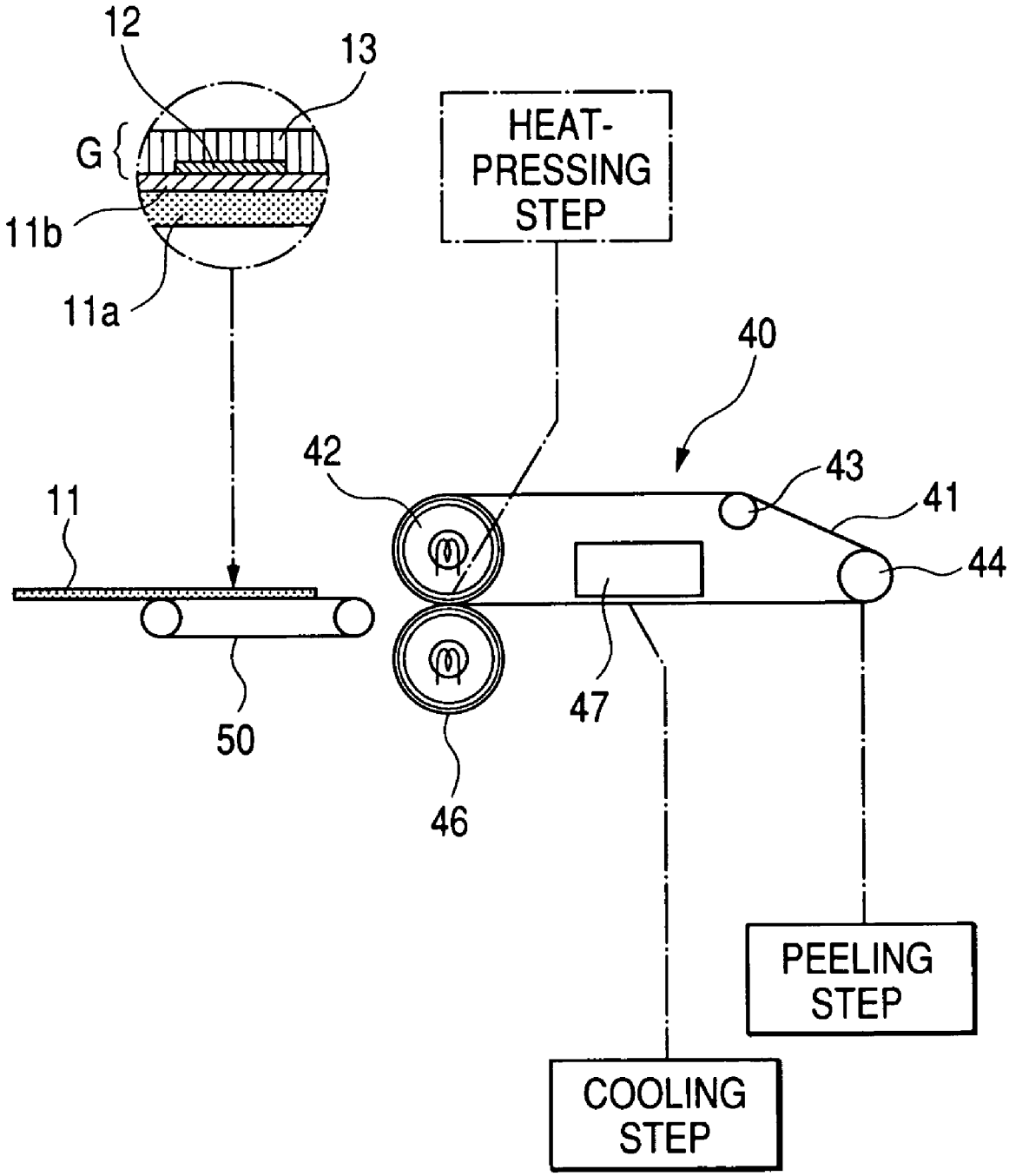
FIG. 7 is a diagram illustrating the image fixing step in the embodiment 2.

Thereafter, the recording medium 11 having the color toner image 12 formed thereon is conveyed to the fixing unit 40 through the conveying unit 50 as shown in FIG. 7.

Explaining next the operation of the fixing unit 40, both the heated roll 42 and the pressure roll 46 are previously heated to the melting temperature of the toner. A load of, e.g., 100 kg is developed between the two rolls 42, 46. The two rolls 42, 46 are rotationally driven. The driving of the rolls 42, 46 is accompanied by the driving of the fixing belt 41.

Then, the fixing belt 41 comes in contact with the surface of the recording medium 11 having the color toner image 12 and the transparent toner image 13 formed thereon at the nip between the heated roll 42 and the pressure roll 46 so that the color toner image 12 and the transparent toner image 13 are heated and melted (heat-pressing step).

At this point, since the melting properties of the transparent toner image 13, even the color toner image 12 on the recording medium 11 has been predetermined within a desired range, the profile of the shape of the fixing belt 41 is then transferred onto the image G on the recording medium 11 as it is.

Then, the recording medium 11 and the fixing belt 41 are conveyed to the peeling roll 44 while being bonded to each other with the melted toner image. During this procedure, the fixing belt 41, the transparent toner image 13, the color toner image 12 and the recording medium 11 are cooled by the heat sink 47 (cooling step).

Therefore, when the recording medium 11 reaches the peeling roll 44, the transparent toner image 13, the color toner image 12 and the recording medium 11 are integrally peeled off the fixing belt 41 by the curvature of the peeling roll 44 (peeling step).

In this manner, a color image having a high glossiness is formed on the recording medium 11.

EXAMPLE

The crystalline polyester resins A to E and the amorphous polyester resins F to K which are thermoplastic resins constituting the transparent toners to be used in Examples 1 to 14 and Comparative Examples 1 to 8 will be described.

Preparation of Crystalline Polyester Resins

Crystalline Polyester Resin A: TPA/ND/BPS=100/95/5 (Molar Ratio)

TPA represents dimethyl terephthalate, ND represents nonanediol, and BPS represents bisphenol S-ethylene oxide adduct.

Into a three-necked flask which had been heated and dried were charged 194 parts by weight of dimethyl terephthalate, 152 parts by weight of 1,9-nonanediol, 16.9 parts by weight of bisphenol S-ethylene oxide adduct and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "crystalline polyester resin A".

The crystalline polyester resin A showed a weight-average molecular weight (Mw) of 23,000 and a number-average molecular weight (Mn) of 12,000 as determined by gel permeation chromatography as calculated in terms of polystyrene.

The melting point (Tm) of the crystalline polyester resin A was measured by the aforementioned method using a differential scanning calorimeter (DSC). As a result, the measurements showed a definite peak. The peak top was at 92° C.

Crystalline Polyester Resin B: TPA/ND/BPA=100/95/5

BPA represents bisphenol A-ethylene oxide adduct.

Into a three-necked flask which had been heated and dried were charged 194 parts by weight of dimethyl terephthalate, 152 parts by weight of 1,9-nonanediol, 15.8 parts by weight of bisphenol A-ethylene oxide adduct and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "crystalline polyester resin B".

The crystalline polyester resin B showed a weight-average molecular weight (Mw) of 22,000 and a number-average molecular weight (Mn) of 10,900 as determined by gel permeation chromatography as calculated in terms of polystyrene.

The melting point (Tm) of the crystalline polyester resin B was measured by the aforementioned method using a differential scanning calorimeter (DSC). As a result, the measurements showed a definite peak. The peak top was at 94° C.

Crystalline Polyester Resin C: TPA/ND/BPA=100/90/10

Into a three-necked flask which had been heated and dried were charged 194 parts by weight of dimethyl terephthalate, 144 parts by weight of 1,9-nonanediol, 31.6 parts by weight of bisphenol A-ethylene oxide adduct and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "crystalline polyester resin C".

The crystalline polyester resin C showed a weight-average molecular weight (Mw) of 22,000 and a number-average molecular weight (Mn) of 11,000 as determined by gel permeation chromatography as calculated in terms of polystyrene.

The melting point (Tm) of the crystalline polyester resin C was measured by the aforementioned method using a differential scanning calorimeter (DSC). As a result, the measurements showed a definite peak. The peak top was at 90° C.

Crystalline Polyester Resin D: TPA/ND=100/100

Into a three-necked flask which had been heated and dried were charged 194 parts by weight of dimethyl terephthalate, 160 parts by weight of 1,9-nonanediol, and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "crystalline polyester resin D".

The crystalline polyester resin D showed a weight-average molecular weight (Mw) of 24,000 and a number-average molecular weight (Mn) of 13,000 as determined by gel permeation chromatography as calculated in terms of polystyrene.

The melting point (Tm) of the crystalline polyester resin D was measured by the aforementioned method using a differential scanning calorimeter (DSC). As a result, the measurements showed a definite peak. The peak top was at 95° C.

Crystalline Polyester Resin E: TPA/ND/BPA=100/95/5

Into a three-necked flask which had been heated and dried were charged 194 parts by weight of dimethyl terephthalate, 152 parts by weight of 1,9-nonanediol 15.8 parts by weight of bisphenol A-ethylene oxide adduct, 136 parts by weight of ethylene glycol and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours. The resulting methanol and excess ethylene glycol were then distilled off under reduced pressure. Thereafter, the mixture was gradually heated to 220° C. under reduced pressure where it was then stirred for 2 hours. When the mixture became viscous, it was then air-cooled to suspend the reaction. The resulting resin was referred to as "crystalline polyester resin E".

The crystalline polyester resin E showed a weight-average molecular weight (Mw) of 43,000 and a number-average molecular weight (Mn) of 22,000 as determined by gel permeation chromatography as calculated in terms of polystyrene.

The melting point (Tm) of the crystalline polyester resin E was measured by the aforementioned method using a differential scanning calorimeter (DSC). As a result, the measurements showed a definite peak. The peak top was at 96° C.

The formulation and properties of the crystalline polyester resins A to E are set forth in FIG. 8.

Preparation of Amorphous Polyester Resins

Amorphous Polyester Resin F: TPA/ND/BPA/BPS=100/25/70/5

Into a three-necked flask which had been heated and dried were charged 194 parts by weight of dimethyl terephthalate, 40 parts by weight of 1,9-nonanediol, 221 parts by weight of bisphenol A-ethylene oxide adduct, 17 parts by weight of bisphenol S-ethylene oxide adduct and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "amorphous polyester resin F".

The amorphous polyester resin F showed a weight-average molecular weight (Mw) of 14,200 and a number-average molecular weight (Mn) of 6,320 as determined by gel permeation chromatography as calculated in terms of polystyrene.

The melting point (Tm) of the amorphous polyester resin F was measured by the aforementioned method using a differential scanning calorimeter (DSC). As a result, the measurements showed no definite peak but a stepwise endothermic change. The glass transition point (Tg) at the intermediate point in the stepwise endothermic change was 55° C.

Amorphous Polyester Resin G: TPA/ND/BPS=100/25/75

Into a three-necked flask which had been heated and dried were charged 194 parts by weight of dimethyl terephthalate, 40 parts by weight of 1,9-nonanediol, 254 parts by weight of bisphenol S-ethylene oxide adduct, and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "amorphous polyester resin G".

The amorphous polyester resin G showed a weight-average molecular weight (Mw) of 13,000 and a number-average molecular weight (Mn) of 6,000 as determined by gel permeation chromatography as calculated in terms of polystyrene.

The melting point (Tm) of the amorphous polyester resin G was measured by the aforementioned method using a differential scanning calorimeter (DSC). As a result, the measurements showed no definite peak but a stepwise endothermic change. The glass transition point (Tg) at the intermediate point in the stepwise endothermic change was 90° C.

Amorphous Polyester Resin H: TPA/ND/BPA=100/25/75

Into a three-necked flask which had been heated and dried were charged 194 parts by weight of dimethyl terephthalate, 40 parts by weight of 1,9-nonanediol, 237 parts by weight of bisphenol A-ethylene oxide adduct, and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "amorphous polyester resin H".

The amorphous polyester resin H showed a weight-average molecular weight (Mw) of 13,000 and a number-average molecular weight (Mn) of 6,000 as determined by gel permeation chromatography as calculated in terms of polystyrene.

The melting point (Tm) of the amorphous polyester resin H was measured by the aforementioned method using a differential scanning calorimeter (DSC). As a result, the measurements showed no definite peak but a stepwise endothermic change. The glass transition point (Tg) at the intermediate point in the stepwise endothermic change was 58° C.

Amorphous Polyester Resin I: TPA/BPS=100/100

Into a three-necked flask which had been heated and dried were charged 194 parts by weight of dimethyl terephthalate, 338 parts by weight of bisphenol S-ethylene oxide adduct, and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "amorphous polyester resin I".

The amorphous polyester resin I showed a weight-average molecular weight (Mw) of 12,000 and a number-average molecular weight (Mn) of 5,600 as determined by gel permeation chromatography as calculated in terms of polystyrene.

The melting point (Tm) of the amorphous polyester resin I was measured by the aforementioned method using a differential scanning calorimeter (DSC). As a result, the measurements showed no definite peak but a stepwise endothermic change. The glass transition point (Tg) at the intermediate point in the stepwise endothermic change was 98° C.

Amorphous Polyester Resin J: TPA/BPA=100/100

Into a three-necked flask which had been heated and dried were charged 194 parts by weight of dimethyl terephthalate, 316 parts by weight of bisphenol A-ethylene oxide adduct, and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "amorphous polyester resin J".

The amorphous polyester resin J showed a weight-average molecular weight (Mw) of 13,000 and a number-average molecular weight (Mn) of 6,000 as determined by gel permeation chromatography as calculated in terms of polystyrene.

The melting point (Tm) of the amorphous polyester resin J was measured by the aforementioned method using a differential scanning calorimeter (DSC). As a result, the measurements showed no definite peak but a stepwise endothermic change. The glass transition point (Tg) at the intermediate point in the stepwise endothermic change was 82° C.

Amorphous Polyester Resin K: TPA/BPA/CHDM=100/80/20

Here, CHDM means cyclohexanedim ethanol.

Into a three-necked flask which had been heated and dried were charged 194 parts by weight of dimethyl terephthalate, 253 parts by weight of bisphenol A-ethylene oxide adduct, 28.8 parts by weight of cyclohexane dimethanol, and 0.15 parts by weight of dibutyltin oxide as a catalyst. The air in the vessel was then replaced by nitrogen gas as an inert atmosphere by vacuum suction. The mixture was then mechanically stirred at 180° C. for 5 hours.

Thereafter, the mixture was gradually heated to 230° C. under reduced pressure where it was then stirred for 2 hours. When the mixture became viscous, it was then air-cooled to suspend the reaction. The resulting resin was referred to as "amorphous polyester resin K".

The amorphous polyester resin K showed a weight-average molecular weight (Mw) of 13,000 and a number-average molecular weight (Mn) of 6,000 as determined by gel permeation chromatography as calculated in terms of polystyrene.

The melting point (Tm) of the amorphous polyester resin K was measured by the aforementioned method using a differential scanning calorimeter (DSC). As a result, the measurements showed no definite peak but a stepwise endothermic change. The glass transition point (Tg) at the intermediate point in the stepwise endothermic change was 65° C.

The formulation and properties of the amorphous polyester resins F to K thus prepared are set forth in FIG. 9.

Example 1

Color Toner Developer 100 parts by weight of a linear polyester obtained from dimethyl terephthalate, bisphenol A-ethylene oxide adduct and cyclohexane dimethanol (molar ratio=5:4:1; Tg=62° C.; Mn=4,500; Mw=10,000) as a binder resin were mixed with 5 parts by weight of benzidine yellow as a coloring agent in the case of yellow toner, 4 parts by weight of pigment red as a coloring agent in the case of magenta toner, 4 parts by weight of phthalocyanine blue as a coloring agent in the case of cyan toner or 5 parts by weight of carbon black as a coloring agent in the case of black toner. The mixtures were each melt-mixed under heating using a Banbury mixer, ground by a jet mill, and then classified through an air classifier to prepare a particulate material having d50 of 7 μm.

To 100 parts of the particulate material thus obtained were then attached the following two inorganic particulate materials a and b using a high speed mixer.

The inorganic particulate material a was $SiO_2$ (hydrophobicized with a silane coupling agent on the surface thereof; average particle diameter: 0.05 μm; added amount: 1.0 part by weight). The inorganic particulate material b was $TiO_2$ (hydrophobicized with a silane coupling agent on the surface thereof; average particle diameter: 0.02 μm; refractive index: 2.5; added amount: 1.0 part by weight).

Tα' (corresponding to the temperature at which viscosity is $10^4$ Pa·s) of the toner was 105° C.

"100 parts by weight of the same carrier as used in the black developer for ACOLOR 635 (produced by Fuji Xerox Co., Ltd.) and 8 parts by weight of the toner were then mixed to prepare a two-component developer."

Color Image Forming Device

As an image forming device there was used the color image forming device shown in FIG. 2 above. The speed of image forming process except fixing step was 160 mm/sec. The weight ratio of toner to carrier, the charging potential of the photoreceptor, the exposure and the development bias were adjusted such that the development of color toners on solid image area were each 0.7 (mg/cm$^2$)

Transparent Toner Developer

Preparation of Transparent Toner Thermoplastic Resin 50 parts by weight of the crystalline polyester resin A and 50 parts by weight of the amorphous polyester resin F were then melt-kneaded by an extrusion kneader which had been heated to 190° C. for 10 minutes to prepare a thermoplastic resin for transparent toner. During the melt-mixing of the resin, when t0 was 5 minutes, T0 was 185° C. Tα of the thermoplastic resin of the transparent toner was 90° C.

Melt Dispersion Granulation

The thermoplastic resin thus obtained was put in a 3% aqueous solution of carboxymethyl cellulose which had been heated to 90° C. in such an amount that the concentration thereof reached 5 mol-%. Using ULTRA-TURRAX T50 (produced by IKA Laboratories Co. Ltd.), the mixture was then subjected to dispersion at a rotary speed of 4,000 rpm for 1 hour.

The dispersion thus obtained was allowed to cool to ordinary temperature. The dispersion was then diluted three times. The dispersion was adjusted to pH 9.5 with a 0.2 M aqueous solution of sodium hydroxide, and then stirred at a rotary speed of 200 rpm using a stirrer for 1 hour.

The dispersion thus obtained was then filtered. The particulate material on the filter paper was washed with water. The particulate material was then adjusted to pH 4.0 with a 0.2 M nitric acid. The solution was then stirred at a rotary speed of 200 rpm using a stirrer for 1 hour. Thereafter, the particulate material was again recovered by filtration, thoroughly washed with water, and then freeze-dried under reduced pressure.

The dispersed particulate material thus obtained was then classified by an air classifier to prepare a particulate material having d50 of 16 μm.

Preparation of Transparent Toner Developer

To 100 parts by weight of the particulate material thus obtained were then attached the following two inorganic particulate materials a and b using a high speed mixer to obtain a transparent toner J1 of Example 1.

Inorganic particulate material a: $SiO_2$ (hydrophobicized with a silane coupling agent on the surface thereof; average particle diameter: 0.05 μm; added amount: 1.0 part by weight)

Inorganic particulate material b: $TiO_2$ (hydrophobicized with a silane coupling agent on the surface thereof; average particle diameter: 0.02 μm; refractive index: 2.5; added amount: 1.0 part by weight)

"8 parts by weight of the transparent toner J1 thus obtained and 100 parts by weight of the same carrier as used in the black developer for ACOLOR 635 (produced by Fuji Xerox Co., Ltd.) were then mixed to prepare a two-component transparent developer D1 of Example 1."

Fixing Unit

As a fixing belt substrate there was used one obtained by spreading a KE4895 silicone rubber (produced by Shin-etsu Chemical Co, Ltd.) over a 80 μm thick polyimide film having an electrically-conductive carbon dispersed therein to a thickness of 50 μm.

As two heated rolls there were used ones obtained by providing a silicone rubber layer on a core made of aluminum to a thickness of 2 mm. The heated rolls each had a halogen lamp provided in the center thereof as a heat source. The temperature of the surface of the two rolls were each varied from 100° C. to 170° C.

The fixing speed was 30 mm/sec.

The temperature of the recording medium at the peeling position was 70° C.

Using the mechanism thus prepared, a portrait photographic picture was outputted.

The toner materials used herein were evaluated in the following manner.

For the measurement of molecular weight, gel permeation chromatography was employed. As a solvent there was used tetrahydrofurane.

The average particle diameter of the toners was measured using a coulter counter. The weight-average d50 was used.

For the measurement of viscosity of resin, a Type RDAII rotary flat plate rheometer (produced by Rheometrix Inc.) was used. The measurement was effected at an angular velocity of 1 rad/sec.

The measurement of visual reflectance Y was effected in the following manner (see FIG. 4).

The thermoplastic resins for transparent toner obtained in the examples and comparative examples were each spread over a color OHP sheet produced by Fuji Xerox Co., Ltd. to the same thickness as in the respective example to prepare a transparent image.

A cover glass for microscope observation was then superposed on the transparent image on the both sides thereof. The gap between the image and the cover glass was then filled with tetradecane.

"The laminate was then measured by X-RITE 968 on a light trap to determine Y'."

A cover glass for microscope observation was then superposed on an OHP sheet free of thermoplastic resin on the both sides thereof. The gap between the image and the cover glass was then filled with tetradecane. The laminate was then measured for Y0 in the aforementioned manner.

Y was calculated by subtracting Y0 from Y'.

Example 2

A color image was prepared in the same manner as in Example 1 except that the thermoplastic resin for transparent toner was changed as follows.

Preparation of Transparent Toner Thermoplastic Resin 50 parts by weight of the crystalline polyester resin A and 50 parts by weight of the amorphous polyester resin G were then melt-kneaded by an extrusion kneader which had been heated to 190° C. for 10 minutes to prepare a thermoplastic resin for transparent toner. During the melt-mixing of the resin, when t0 was 5 minutes, T0 was 170° C. Tα of the thermoplastic resin of the transparent toner was 105° C.

Example 3

A color image was prepared in the same manner as in Example 1 except that the thermoplastic resin for transparent toner was changed as follows.

Preparation of Transparent Toner Thermoplastic Resin 50 parts by weight of the crystalline polyester resin A and 50 parts by weight of the amorphous polyester resin H were then melt-kneaded by an extrusion kneader which had been heated to 190° C. for 10 minutes to prepare a thermoplastic resin for transparent toner. During the melt-mixing of the resin, when t0 was 5 minutes, T0 was 170°C. Tα of the thermoplastic resin of the transparent toner was 85° C.

Example 4

A color image was prepared in the same manner as in Example 1 except that the thermoplastic resin for transparent toner was changed as follows.

Preparation of Transparent Toner Thermoplastic Resin 50 parts by weight of the crystalline polyester resin B and 50 parts by weight of the amorphous polyester resin H were then melt-kneaded by an extrusion kneader which had been heated to 190° C. for 10 minutes to prepare a thermoplastic resin for transparent toner. During the melt-mixing of the resin, when t0 was 5 minutes, T0 was 185° C. Tα of the thermoplastic resin of the transparent toner was 90° C.

Example 5

A color image was prepared in the same manner as in Example 1 except that the thermoplastic resin for transparent toner was changed as follows.

Preparation of Transparent Toner Thermoplastic Resin 40 parts by weight of the crystalline polyester resin B and 60 parts by weight of the amorphous polyester resin H were then melt-kneaded by an extrusion kneader which had been heated to 190° C. for 10 minutes to prepare a thermoplastic resin for transparent toner. During the melt-mixing of the resin, when t0 was 5 minutes, T0 was 190° C. Tα of the thermoplastic resin of the transparent toner was 95° C.

Example 6

A color image was prepared in the same manner as in Example 1 except that the thermoplastic resin for transparent toner was changed as follows.

Preparation of Transparent Toner Thermoplastic Resin 60 parts by weight of the crystalline polyester resin B and 40 parts by weight of the amorphous polyester resin H were then melt-kneaded by an extrusion kneader which had been heated to 190° C. for 10 minutes to prepare a thermoplastic resin for transparent toner. During the melt-mixing of the resin, when t0 was 5 minutes, T0 was 180° C. Tα of the thermoplastic resin of the transparent toner was 90° C.

Example 7

A color image was prepared in the same manner as in Example 1 except that the thermoplastic resin for transparent toner was changed as follows.

Preparation of Transparent Toner Thermoplastic Resin 50 parts by weight of the crystalline polyester resin C and 50 parts by weight of the amorphous polyester resin H were then melt-kneaded by an extrusion kneader which had been heated to 190° C. for 10 minutes to prepare a thermoplastic resin for transparent toner. During the melt-mixing of the resin, when t0 was 5 minutes, T0 was 165° C. Tα of the thermoplastic resin of the transparent toner was 85° C.

Example 8

A color image was prepared in the same manner as in Example 1 except that the thermoplastic resin for transparent toner was changed as follows.

Preparation of Transparent Toner Thermoplastic Resin 50 parts by weight of the crystalline polyester resin D and 50 parts by weight of the amorphous polyester resin H were then melt-kneaded by an extrusion kneader which had been heated to 210° C. for 10 minutes to prepare a thermoplastic resin for transparent toner. During the melt-mixing of the resin, when t0 was 5 minutes, T0 was 200° C. Tα of the thermoplastic resin of the transparent toner was 90° C.

Example 9

A color image was prepared in the same manner as in Example 1 except that the thermoplastic resin for transparent toner was changed as follows.

Preparation of transparent Toner Thermoplastic Resin 50 parts by weight of the crystalline polyester resin B and 50 parts by weight of the amorphous polyester resin I were then melt-kneaded by an extrusion kneader which had been heated to 200° C. for 10 minutes to prepare a thermoplastic resin for transparent toner. During the melt-mixing of the resin, when t0 was 5 minutes, T0 was 195° C. Tα of the thermoplastic resin of the transparent toner was 105° C.

Example 10

A color image was prepared in the same manner as in Example 1 except that the thermoplastic resin for transparent toner was changed as follows.

Preparation of Transparent Toner Thermoplastic Resin 50 parts by weight of the crystalline polyester resin D and 50 parts by weight of the amorphous polyester resin K were then melt-kneaded by an extrusion kneader which had been heated to 200° C. for 10 minutes to prepare a thermoplastic resin for transparent toner. During the melt-mixing of the resin, when t0 was 5 minutes, T0 was 220° C. Tα of the thermoplastic resin of the transparent toner was 105° C.

Example 11

A color image was prepared in the same manner as in Example 1 except that the thermoplastic resin for transparent toner was changed as follows.

Preparation of Transparent Toner Thermoplastic Resin 50 parts by weight of the crystalline polyester resin D and 50 parts by weight of the amorphous polyester resin J were then melt-kneaded by an extrusion kneader which had been heated to 210° C. for 10 minutes to prepare a thermoplastic resin for transparent toner. During the melt-mixing of the resin, when t0 was 5 minutes, T0 was 210° C. Tα of the thermoplastic resin of the transparent toner was 95° C.

Example 12

A color image was prepared in the same manner as in Example 1 except that the thermoplastic resin for transparent toner was changed as follows.

Preparation of Transparent Toner Thermoplastic Resin 50 parts by weight of the crystalline polyester resin E and 50 parts by weight of the amorphous polyester resin J were then melt-kneaded by an extrusion kneader which had been heated to 210° C. for 10 minutes to prepare a thermoplastic resin for transparent toner. During the melt-mixing of the resin, when t0 was 5 minutes, T0 was 190° C. Tα of the thermoplastic resin of the transparent toner was 105° C.

Example 13

A color image was prepared in the same manner as in Example 1 except that the thermoplastic resin for transparent toner was changed as follows.

Preparation of Transparent Toner Thermoplastic Resin 50 parts by weight of the crystalline polyester resin B, 50 parts by weight of the amorphous polyester resin H and 10 parts by weight of titanium dioxide (KA-10; particle diameter: 300 to 500 nm, produced by TITAN KOGYO KABUSHIKI KAISHA) were then melt-kneaded by an extrusion kneader which had been heated to 200° C. for 20 minutes to prepare a thermoplastic resin for transparent toner. During the melt-mixing of the resin, when t0 was 5 minutes, T0 was 185° C. Tα of the thermoplastic resin of the transparent toner was 90° C.

Example 14

A color image was prepared in the same manner as in Example 1 except that the color toner was changed as follows.

Color Toner

A color toner for DCC500 (produced by Fuji Xerox Co., Ltd.) was used. Tα' of the toner was 100° C.

Comparative Example 1

A color image was prepared in the same manner as in Example 1 except that the thermoplastic resin for transparent toner was changed as follows.

Preparation of Transparent Toner Thermoplastic Resin 50 parts by weight of the crystalline polyester resin E and 50 parts by weight of the amorphous polyester resin J were then melt-kneaded by an extrusion kneader which had been heated to 185° C. for 10 minutes to prepare a thermoplastic resin for transparent toner. During the melt-mixing of the resin, when t0 was 5 minutes, T0 was 190° C. Tα of the thermoplastic resin of the transparent toner was 115° C.

Comparative Example 2

A color image was prepared in the same manner as in Example 1 except that the thermoplastic resin for transparent toner was changed as follows.

Preparation of Transparent Toner Thermoplastic Resin

The crystalline polyester resin A was used as a thermoplastic resin for transparent toner. Tα of the thermoplastic resin for transparent toner was 85° C.

Comparative Example 3

A color image was prepared in the same manner as in Example 1 except that the thermoplastic resin for transparent toner was changed as follows.

Preparation of Transparent Toner Thermoplastic Resin

The crystalline polyester resin D was used as a thermoplastic resin for transparent toner. Tα of the thermoplastic resin for transparent toner was 95° C.

Comparative Example 4

A color image was prepared in the same manner as in Example 1 except that the thermoplastic resin for transparent toner was changed as follows.

Preparation of Transparent Toner Thermoplastic Resin

The crystalline polyester resin E was used as a thermoplastic resin for transparent toner. Tα of the thermoplastic resin for transparent toner was 105° C.

Comparative Example 5

A color image was prepared in the same manner as in Example 1 except that the thermoplastic resin for transparent toner was changed as follows.

Preparation of Transparent Toner Thermoplastic Resin

The amorphous polyester resin J was used as a thermoplastic resin for transparent toner. Tα of the thermoplastic resin for transparent toner was 135° C.

Comparative Example 6

A color image was prepared in the same manner as in Example 1 except that the thermoplastic resin for transparent toner was changed as follows.

Preparation of Transparent Toner Thermoplastic Resin

The amorphous polyester resin K was used as a thermoplastic resin for transparent toner. Tα of the thermoplastic resin for transparent toner was 115° C.

Comparative Example 7

A color toner image was prepared in the same manner as in Example 1 except that no transparent toner was used.

Comparative Example 8

A color image was prepared in the same manner as in Example 1 except that the thermoplastic resin for transparent toner was changed as follows.

Preparation of Transparent Toner Thermoplastic Resin 50 parts by weight of the crystalline polyester resin D and 50 parts by weight of the amorphous polyester resin H were then melt-kneaded by an extrusion kneader which had been heated to 185° C. for 10 minutes to prepare a thermoplastic resin for transparent toner. During the melt-mixing of the resin, when t0 was 5 minutes, T0 was 200° C. Tα of the thermoplastic resin of the transparent toner was 90° C.

The experiment conditions in Examples 1 to 14 and Comparative Examples 1 to 8 are set forth in FIG. 10.

Evaluation Test

The transparent toners and the two-component transparent developers of Examples 1 to 14 and Comparative Examples 1 to 8 were subjected to the following evaluation tests during their production, color image formation and other occasions.

Evaluation of Producibility

Dispersibility

"When the polyester resin was subjected to dispersion in a dispersing device ( ULTRA-TURRAX T50) to obtain dispersion (shortly before being filtered through a filter paper) during the production of transparent toners of Examples and Comparative Examples, the ratio of residues left undispersed and attached to the wall and bottom of the vessel of the dispersing device to the total amount of the polyester resin charged in the dispersing device (dispersion residue [mol-%]) was examined. The dispersion residue was determined to evaluate dispersibility according to the following criterion. The dispersibility thus determined can be an index of producibility."

G: Less than 20 mol-%;

F: From not smaller than 20 mol-% to less than 40 mol-%; and

P: More than 40 mol-%

Evaluation of Image

Mechanical Strength

The recording media obtained in the aforementioned examples and comparative examples were each wound on metal rolls having different radii. The minimum radius at which no crack occurs was then examined.

When the minimum radius was less than 10 mm, the mechanical strength was judged good. When the minimum radius was from not smaller than 10 mm to less than 30 mm, the mechanical strength was judged fair. When the minimum radius was more than 30 mm, the mechanical strength was judged poor.

Heat Resistance

Sheets of the recording media obtained in Examples and Comparative Examples were stored in a constant temperature tank kept at a constant temperature in such an arrangement that the surface of the sheets were brought into contact with each other under a load of 30 g/cm$^2$ for 3 days. The laminate was then returned to an atmosphere of room temperature (about 22° C.). The two sheets were then peeled off each other. This test was repeated at various temperatures. When the temperature at which the surface of image was destroyed was 55° C. or more, the heat resistance of the image was judged good. When the temperature at which the surface of image was destroyed was from not lower than 45° C. to less than 55° C. or more, the heat resistance of the image was judged fair. When the temperature at which the surface of image was destroyed was 45° C. or less, the heat resistance of the image was judged poor.

Low Temperature Fixability

Evaluation of Glossiness

The images obtained in the examples and comparative examples were each measured for glossiness on the white area using a 75 degree gloss meter (produced by MURAKAMI COLOR RESEARCH LABORATORY). When the fixing temperature at which glossiness is 90 or more was less than 110° C., glossiness was judged good. When the fixing temperature at which glossiness is 90 or more was from not lower than 110° C. to less than 130° C., glossiness was judged fair. When the fixing temperature at which glossiness is 90 or more was more than 130° C., glossiness was judged poor.

Evaluation of Smoothness

The images obtained in the examples and comparative examples were each visually observed for smoothness. When the temperature at which no bubbles are recognized on the surface of image was 30° C. or more, the image smoothness was judged good. When the temperature at which no bubbles are recognized on the surface of image was from not lower than 10° C. to less than 30° C. or more, the image smoothness was judged fair. When the temperature at which no bubbles are recognized on the surface of image was more than 10° C., the image smoothness was judged poor.

Solidification Speed

The solidification speed was evaluated as follows.

When the image outputted from the fixing unit was solidified so much that no fingerprints are left thereon even when touched by hands, the solidification speed was judged good.

When the image outputted from the fixing unit was sufficiently solidified but showed no surface defects and showed no smoothness problems when the subsequently outputted image was superposed thereon, the solidification speed was judged fair.

When the image outputted from the fixing unit was not solidified and smooth, showed uneven gloss and could not be peeled off the peeling roll even when passing by the peeling roll, the solidification speed was judged poor.

General Image Quality

The images obtained at the fixing temperature of 140° C. in the examples and comparative examples were each evaluated for general desirableness according to the following five-step criterion:

Very desirable: 5 scores

Desirable: 4 scores

Fair: 3 scores

Undesirable: 2 scores

Very undesirable: 1 score

The evaluation was made by 10 examiners.

When the scores averaged by the 10 examiners was 3.5 or more, the general image quality was judged good. When the scores averaged by the 10 examiners was from not lower than 2.5 to less than 3.5, the general image quality was judged fair. When the scores averaged by the 10 examiners was less than 2.5, the general image quality was judged poor.

Results of Image Evaluation

The results of the aforementioned image evaluation are set forth in FIG. 11.

As can be seen in FIG. 11, the images of Examples 1 to 14 satisfied all the requirements for mechanical strength, heat resistance and low temperature fixability (no failure). The images of Examples 1 to 14 showed a high general image quality and hence a desirable quality. In particular, the images of Examples 1 to 3 showed a good wet-processability as well as good mechanical strength and heat resistance.

The image of Example 2 showed a slightly low smoothness and a fair general quality but satisfied the other requirements. The image of Example 12 showed a slightly low gloss and a fair general quality but satisfied the other requirements. Thus, these images were practically acceptable.

On the contrary, the image of Comparative Example 1 showed good low temperature fixability and heat resistance. When the fixing temperature was 130° C., a large number of bubbles having a size about 1 mm were generated probably because the toner-receiving layer was melted. Probably for the same reason, when the fixing temperature was 130° C. or more, graininess was deteriorated.

The image of Comparative Example 2 was peeled off by the peeling roll but showed uneven gloss on the surface thereof because it was not completely solidified on the surface layer when the subsequently outputted image was superposed thereon.

The image of Comparative Example 3 was not peeled off by the peeling roll. After passing by the peeling roll, the image was peeled off by hand. As a result, the surface of the image was not smooth and showed uneven gloss.

The image of Comparative Example 4 was not peeled off by the peeling roll. After passing by the peeling roll, the image was peeled off by hand. As a result, the surface of the image was not smooth and showed uneven gloss.

The image of Comparative Example 5 showed no desirable gloss at a fixing temperature of 145° C. where the light diffusion layer begins to melt. At a fixing temperature of 150° C., the image was observed to have bubbles having a size of 1 mm or more. Further, the image was curled so much that the surface thereof was cracked.

The image of comparative Example 6 showed no desirable gloss at a fixed temperature of 145° C. where the light diffusion layer begins to melt. At a fixing temperature of 150° C., the image was observed to have bubbles having a size of 1 mm or more. Further, the image was curled so much that the surface thereof was cracked. The image of Comparative Example 7 showed a high gloss on the low density area and high density area but showed a good smoothness and a low gloss on the middle density area.

The image of Comparative Example 8 became milky and showed a very poor general quality.

As can be seen in the foregoing description, the use of Examples 1 to 14 makes it possible to provide a transparent toner which satisfies the all of mechanical strength, heat resistance and low temperature fixability and can be solidified at a high speed to obtain a desirable image having a high general quality and a gloss-providing unit and an image forming device capable of preparing a desirable image using the transparent toner.

What is claimed is:

1. A transparent toner to be used for a transparent toner image formed with a color toner image on a recording medium, wherein the said transparent toner comprises:

a crystalline polyester resin;

and an amorphous polyester resin, wherein a thermoplastic resin constituting the transparent toner is made of a resin obtained by melt-mixing the crystalline polyester resin and the amorphous polyester resin under the conditions which require that T (° C.) is predetermined to be from T0 to (T0+30), t (minute) is predetermined to be from t0 to (10×t0) and the temperature Tα at which the viscosity of the thermoplastic resin is $10^3$ Pa·s is from 70° C. to 110° C., wherein T0 (° C.) is the temperature at which the visual reflectance Y of 20 μm thick film formed by the thermoplastic resin obtained by melt-mixing the crystalline polyester resin and the amorphous resin for a period of time t0 (minute) is 1.5%, the melt-mixing temperature is T (° C.) and the melt-mixing time is t (minute).

2. The transparent toner according to claim 1, wherein the weight ratio of the crystalline polyester resin to the amorphous resin among the thermoplastic resins constituting the transparent toner is from 35:65 to 65:35.

3. The transparent toner according to claim 1, wherein the temperature T (° C.) is predetermined to be from (T0+5) to (T0+10) and the time t (minute) is predetermined to be from t0 to (3×t0).

4. The transparent toner according to claim 1, wherein the crystalline polyester resin and the amorphous polyester resin comprise an alcohol-derived constituent, or an acid-derived constituent, in common with each other.

5. The transparent toner according to claim 4, wherein the crystalline polyester resin and the amorphous resin each are formed by three or more monomers and at least one alcohol-derived constituent or at least one acid-derived constituent which are in common with each other.

6. The transparent toner according to claim 4, wherein the crystalline polyester resin and the amorphous resin each are formed by three or more monomers and the crystalline polyester resin comprises the same alcohol-derived constituents and acid- derived constituents as the amorphous resin.

7. The transparent toner according to claim 4, wherein the alcohol-derived constituents of the crystalline polyester resin comprise a $C_6$-$C_{12}$ straight-chain aliphatic group as a main component in an amount of from 85 to 98 mol-% based on the total amount of the alcohol-derived constituents and the acid-derived constituents of the crystalline polyester resin comprise an aromatic group derived from terephthalic acid, isophthalic acid or naphthalenedicarboxylic acid in an amount of 90 mol-% or more based on the total amount of the acid-derived constituents.

8. The transparent toner according to claim 4, wherein the alcohol-derived constituents of the amorphous polyester resin comprise the same straight-chain aliphatic group as a $C_6$-$C_{12}$ straight-chain aliphatic group which is a main component of the alcohol-derived constituents of the crystalline polyester resin in an amount of from 10 to 30 mol-% based on the total amount of the alcohol-derived constituents and the acid-derived constituents of the amorphous polyester resin comprise the same aromatic group as an aromatic group derived from terephthalic acid, isophthalic acid or naphthalenedicarboxylic acid in an amount of 90 mol-% or more based on the total amount of the acid-derived constituents.

9. The transparent toner according to claim 4, wherein the alcohol-derived constituents of the crystalline polyester resin comprise a $C_6$-$C_{12}$ straight-chain aliphatic group and an aromatic component in an amount of from 85 to 98 mol-% and from 2 to 15 mol-% based on the total amount of the alcohol-derived constituents, respectively, and wherein the alcohol-derived constituents of the amorphous polyester resin comprise the same straight-chain aliphatic group and aromatic component as the main components of the alcohol-derived constituents of the crystalline polyester resin in an amount of from 10 to 30 mol-% and from 70 to 90mol-% based on the total amount of the alcohol-derived constituents, respectively, and an aromatic component which is the main component of the acid-derived constituents of the crystalline polyester resin and the amorphous polyester resin are formed by the same material.

10. The transparent toner according to claim 9, wherein the crystalline polyester resin comprises bisphenol S or bisphenol S-alkylene oxide adduct incorporated therein in an amount of from 2 to 15 mol-% based on the total amount of the alcohol-derived constituents.

11. The transparent toner according to claim 9, wherein the amorphous polyester resin includes bisphenol S or bisphenol S-alkylene oxide adduct incorporated therein in an amount of from 70 to 90 mol-% based on the total amount of the alcohol-derived constituents.

12. The transparent toner according to claim 4, wherein the alcohol-derived constituents of the amorphous polyester resin include the same straight-chain aliphatic group and aromatic diol-derived component as the main components of the alcohol-derived constituents of the crystalline polyester resin in an amount of from 10 to 30 mol-% and from 70 to 90 mol-% based on the total amount of the alcohol-derived constituents, respectively, and an aromatic component which is the main component of the acid-derived constituents of the crystalline polyester resin and the amorphous polyester resin are formed by the same material.

13. The transparent toner according to claim 1, wherein the weight-average molecular weight of the crystalline polyester resin is from 17,000 to 40,000 and the weight-average molecular weight of the amorphous polyester resin is from 8,000 to 16,000.

14. A transparent toner to be used for a transparent toner image formed with a color toner image on a recording medium, wherein the said transparent toner comprises:

a crystalline polyester resin;

and an amorphous polyester resin, wherein a thermoplastic resin constituting the transparent toner is made of a resin obtained by melt-mixing the crystalline polyester resin and the amorphous polyester resin under the conditions which require that T (° C.) is predetermined to be from T0 to (T0+30), t (minute) is predetermined to be from t0 to (10×t0) and the temperature Tα at which the viscosity of the thermoplastic resin is $10^3$ Pa·s is from 70° C. to 110° C., wherein T0 (° C.) is the temperature at which the visual reflectance Y of 20μm thick film formed by the thermoplastic resin obtained by melt-mixing the crystalline polyester resin and the amorphous resin for a period of time t0 (minute) is 1.5%, the melt-mixing temperature is T (° C.) and the melt-mixing time is t (minute)

wherein Tα (° C.) is the temperature at which the viscosity of the thermoplastic resin constituting the transparent toner is $10^3$ Pa·s and Tα' (° C.) is the temperature at which the viscosity of a thermoplastic resin constituting a color toner is $10^4$ Pa·s, and wherein Tα and Tα' satisfy the following relationship: $T\alpha \leqq T\alpha' \leqq T\alpha+25$ (° C.).

15. A developer comprising:

a transparent toner; and a carrier, wherein:

the transparent toner is made of a thermoplastic resin obtained by melt-mixing a crystalline polyester resin and an amorphous resin under the conditions which require that T (° C.) is predetermined to be from T0 to (T0+30), t (minute) is predetermined to be from t0 to (10×t0) and the temperature Tα at which the viscosity of the thermoplastic resin is $10^3$ Pa·s is from 70° C. to 110° C.; wherein T0 (° C.) is the temperature at which the visual reflectance Y of 20 μm thick film formed by the thermoplastic resin obtained by melt-mixing the crystalline polyester resin and the amorphous resin for a period of time t0 (minute) is 1.5%, the melt-mixing temperature is T (° C.) and the melt-mixing time is t (minute).

* * * * *